US011776739B2

(12) United States Patent
Kondo

(10) Patent No.: US 11,776,739 B2
(45) Date of Patent: Oct. 3, 2023

(54) IGNITION COIL FOR INTERNAL COMBUSTION ENGINE

(71) Applicant: DENSO CORPORATION, Kariya (JP)

(72) Inventor: Yuki Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 210 days.

(21) Appl. No.: 17/468,859

(22) Filed: Sep. 8, 2021

(65) Prior Publication Data

US 2022/0076883 A1 Mar. 10, 2022

(30) Foreign Application Priority Data

Sep. 10, 2020 (JP) ..... 2020-151710

(51) Int. Cl.

| | |
|---|---|
| ***H01F 38/12*** | (2006.01) |
| ***H01F 27/02*** | (2006.01) |
| ***H01F 27/28*** | (2006.01) |
| ***F02P 3/02*** | (2006.01) |
| ***H01F 27/24*** | (2006.01) |

(52) U.S. Cl.

CPC ..... *H01F 38/12* (2013.01); *F02P 3/02* (2013.01); *H01F 27/02* (2013.01); *H01F 27/24* (2013.01); *H01F 27/28* (2013.01)

(58) Field of Classification Search

CPC ..... H01F 38/12; H01F 27/02; H01F 27/24; H01F 27/28; F02P 3/02

See application file for complete search history.

(56) References Cited

U.S. PATENT DOCUMENTS

2019/0162156 A1* 5/2019 Kondo ..... F02P 3/055

FOREIGN PATENT DOCUMENTS

JP 2009-188364 8/2009

* cited by examiner

*Primary Examiner* — Jacob M Amick

(74) *Attorney, Agent, or Firm* — Nixon & Vanderhye P.C.

(57) ABSTRACT

An ignition coil includes a primary coil, a secondary coil, a center core, an outer core, an igniter, a coil case and an electrically-insulative fixation resin. On an interior surface of the coil case on a bottom part side in a mounting direction, there is formed a case-side rib to protrude from the interior surface of the coil case to a high-voltage side in an axial direction. The case-side rib has a taper shape such that the protruding amount of the case-side rib to the high-voltage side in the axial direction increases in the mounting direction toward the bottom part side. The case-side rib is arranged to abut a corner portion of the igniter on the bottom part side in the mounting direction and on a low-voltage side in the axial direction and thereby press the igniter against the outer core.

10 Claims, 18 Drawing Sheets

IGNITION COIL FOR INTERNAL COMBUSTION ENGINE

CROSS-REFERENCE TO RELATED APPLICATION

This application is based on and claims priority from Japanese Patent Application No. 2020-151710 filed on Sep. 10, 2020, the contents of which are hereby incorporated by reference in their entirety into this application.

BACKGROUND

1. Technical Field

The present disclosure relates to ignition coils for internal combustion engines.

2. Description of Related Art

In internal combustion engines, there are employed ignition coils for igniting an air-fuel mixture in combustion chambers of the internal combustion engines. The ignition coils generally include a primary coil, a secondary coil, an igniter, a center core and an outer core. The secondary coil is arranged outside and coaxially with the primary coil so as to be magnetically coupled with the primary coil. The igniter includes a switching element for selectively permitting and interrupting electric power supply to the primary coil. The center core and the outer core are provided to allow magnetic flux generated by the primary coil and the secondary coil to flow therethrough.

In operation, the temperature of the igniter is increased by heat generated by the switching element. Therefore, for keeping the temperature of the igniter within a heatproof temperature range, efforts have been made to facilitate cooling of the igniter. For example, Japanese Patent Application Publication No. JP 2009-188364 A discloses an ignition coil in which: the igniter is arranged in a coil case to face the outer core with a gap formed therebetween; and a resin for electrical insulation and fixation is filled in the gap between the igniter and the outer core. Moreover, a heat sink provided on a circuit board of the igniter is arranged on the outer core side. With the above configuration, heat generated by the switching element of the igniter can be dissipated to the outer core via the heat sink and the resin, thereby suppressing increase in the temperature of the igniter.

SUMMARY

According to the present disclosure, there is provided a first ignition coil for an internal combustion engine. The first ignition coil includes a primary coil, a secondary coil, a center core, an outer core, an igniter, a coil case and an electric ally-insulative fixation resin. The primary coil is configured to be supplied with electric power. The secondary coil is arranged outside and coaxially with the primary coil. The secondary coil is configured to generate an induced electromotive force upon interruption of the electric power supply to the primary coil. The center core is arranged inside the primary coil. The outer core is quadrangular ring-shaped to have four parts thereof located respectively on opposite sides of the secondary coil in an axial direction and opposite sides of the secondary coil in a width direction perpendicular to the axial direction. The outer core and the center core together form a closed magnetic circuit in the ignition coil.

The igniter includes a switching element configured to selectively permit and interrupt the electric power supply to the primary coil. The igniter is arranged, on a low-voltage side of the outer core in the axial direction, adjacent to the outer core. The coil case has an opening on one side in a mounting direction and a bottom part on the other side in the mounting direction; the mounting direction is perpendicular to both the axial direction and the width direction. The coil case has all of the primary coil, the secondary coil, the center core, the outer core and the igniter received therein. The electrically-insulative fixation resin is filled in spaces in the coil case to fix the primary coil, the secondary coil, the center core, the outer core and the igniter in the coil case while electrically insulating them from each other. Moreover, on an interior surface of the coil case on the bottom part side in the mounting direction, there is formed a case-side rib to protrude from the interior surface of the coil case to a high-voltage side in the axial direction; the high-voltage side is opposite to the low-voltage side in the axial direction. The case-side rib has a taper shape such that the protruding amount of the case-side rib to the high-voltage side in the axial direction increases in the mounting direction toward the bottom part side. The case-side rib is arranged to abut a corner portion of the igniter on the bottom part side in the mounting direction and on the low-voltage side in the axial direction and thereby press the igniter against the outer core.

According to the present disclosure, there is also provided a second ignition coil for an internal combustion engine. The second ignition coil includes a primary coil, a secondary coil, a center core, an outer core, an igniter, a coil case, a connector and an electrically-insulative fixation resin. The primary coil is configured to be supplied with electric power. The secondary coil is arranged outside and coaxially with the primary coil. The secondary coil is configured to generate an induced electromotive force upon interruption of the electric power supply to the primary coil. The center core is arranged inside the primary coil. The outer core is quadrangular ring-shaped to have four parts thereof located respectively on opposite sides of the secondary coil in an axial direction and opposite sides of the secondary coil in a width direction perpendicular to the axial direction. The outer core and the center core together form a closed magnetic circuit in the ignition coil. The igniter includes a switching element configured to selectively permit and interrupt the electric power supply to the primary coil. The igniter is arranged, on a low-voltage side of the outer core in the axial direction, adjacent to the outer core. The coil case has an opening on one side in a mounting direction and a bottom part on the other side in the mounting direction; the mounting direction is perpendicular to both the axial direction and the width direction. The coil case has all of the primary coil, the secondary coil, the center core, the outer core and the igniter received therein. The connector is mounted to the coil case so as to protrude outside the coil case. The connector has a connector wall portion that constitutes part of the coil case on the low-voltage side in the axial direction. The electric ally-insulative fixation resin is filled in spaces in the coil case to fix the primary coil, the secondary coil, the center core, the outer core and the igniter in the coil case while electrically insulating them from each other. Moreover, on an interior surface of the connector wall portion, there is formed a connector-side rib to protrude from the interior surface of the connector wall portion to a high-voltage side in the axial direction; the high-voltage side is opposite to the low-voltage side in the axial direction. The connector-side rib has a taper part tapered such that the protruding amount of the taper part from the interior surface of the connector wall portion to the high-voltage side in the axial direction increases in the mounting direction toward the opening side. The connector-side rib is arranged to press the igniter against the outer core.

DESCRIPTION OF EMBODIMENTS

Figure 1:
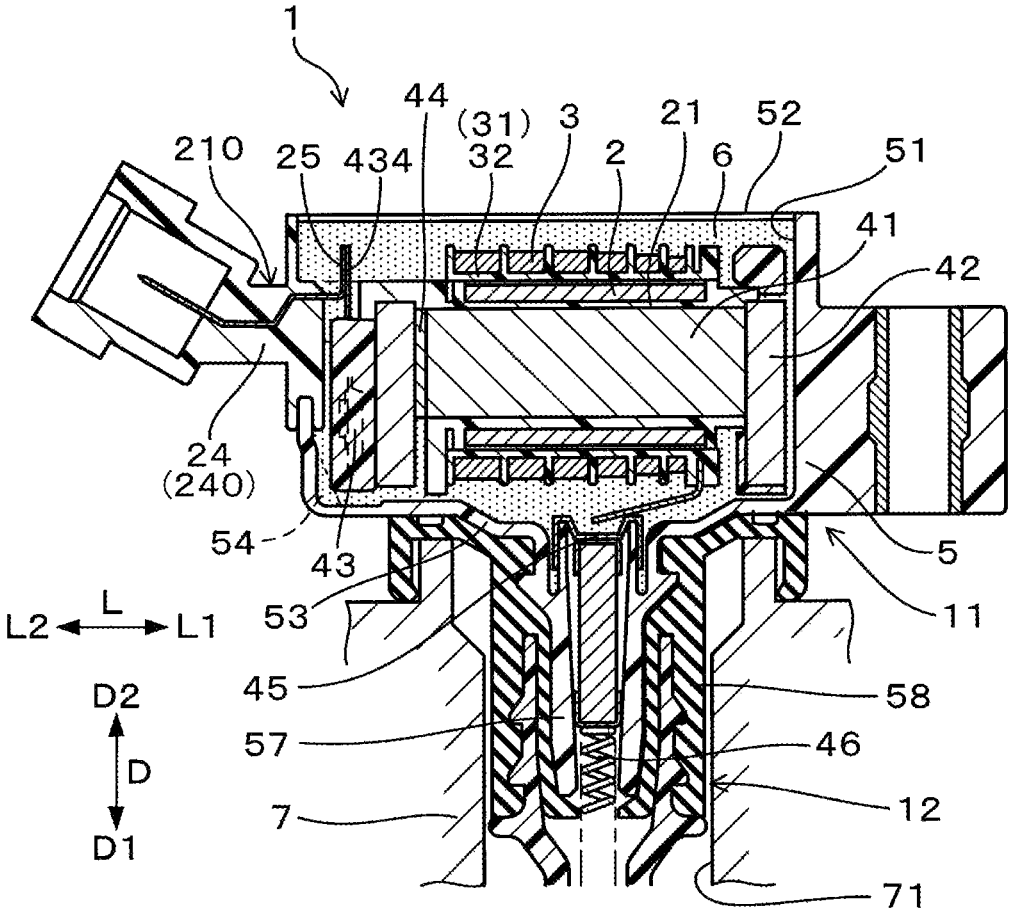
FIG. 1 is a cross-sectional view, perpendicular to a width direction, of an ignition coil according to a first embodiment.

In recent years, with tightening of regulations on exhaust gas and fuel economy, it has been required to increase the outputs of ignition coils. Moreover, the outputs of ignition coils may be increased by, for example, increasing the electric current when electric power supply to the primary coil is interrupted by the switching element of the igniter. However, in this case, the amount of electric power consumed by the switching element of the igniter would be increased; thus it would become necessary to further facilitate cooling of the igniter.

In the ignition coil disclosed in the aforementioned patent document (i.e., JP 2009-188364 A), a gap is intentionally provided between the igniter and the outer core and a resin for electrical insulation and fixation is filled in the gap. However, when the gap between the igniter and the outer core is large, it may be difficult to effectively dissipate heat generated by the switching element of the igniter to the outer core.

In contrast, with the configuration of the above-described first ignition coil according to the present disclosure, the corner portion of the igniter is brought into abutment with the case-side rib when the igniter is placed into the coil case that has the outer core and the like already arranged therein. At this time, the igniter is shifted by the case-side rib toward the outer core. Consequently, it becomes possible for the igniter to be suitably pressed against the outer core. As a result, it becomes possible for heat to be effectively dissipated from the igniter to the outer core.

Moreover, with the configuration of the above-described second ignition coil according to the present disclosure, the igniter is brought into abutment with the taper part of the connector-side rib when the igniter is assembled to a coil assembly that has the primary coil, the secondary coil, the center core and the outer core already assembled therein or when the connector is mounted to the coil case that has the igniter, the outer core and the like already arranged therein. At this time, the igniter is shifted by the taper part of the connector-side rib toward the outer core. Consequently, it becomes possible for the igniter to be suitably pressed against the outer core. As a result, it becomes possible for heat to be effectively dissipated from the igniter to the outer core.

Exemplary embodiments will be described hereinafter with reference to the drawings. It should be noted that for the sake of clarity and understanding, identical components having identical functions throughout the whole description have been marked, where possible, with the same reference numerals in the drawings and that for the sake of avoiding redundancy, descriptions of identical components will not be repeated.

First Embodiment

Figure 2:
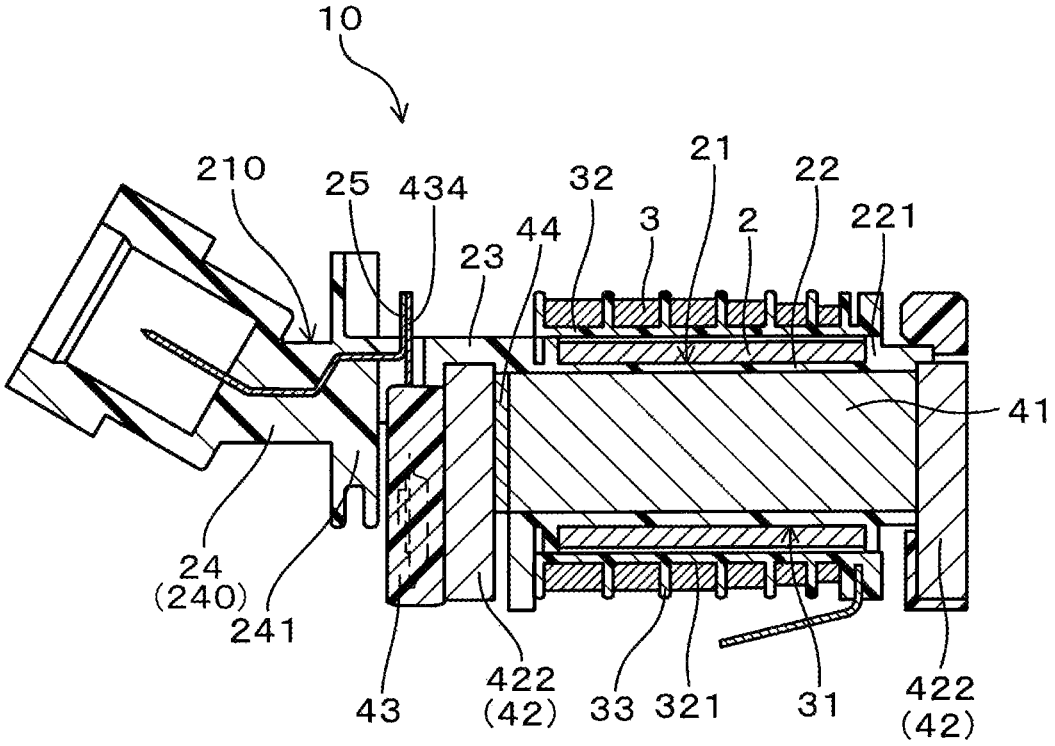
FIG. 2 is a cross-sectional view, perpendicular to the width direction, of a coil assembly before being placed in a coil case, the coil assembly and the coil case together constituting part of the ignition coil according to the first embodiment.
Figure 3:
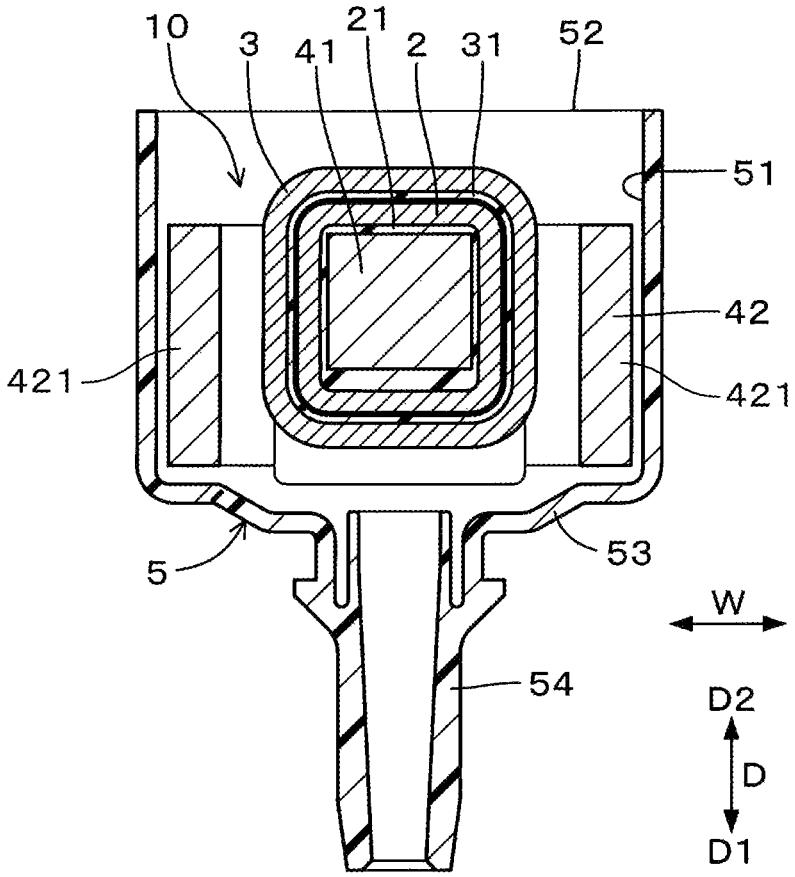
FIG. 3 is a cross-sectional view, perpendicular to an axial direction, of the ignition coil according to the first embodiment before an electrically-insulative fixation resin is filled into spaces in the coil case.

As shown in FIGS. 1-3, an ignition coil 1 for an internal combustion engine according to the first embodiment includes a primary coil 2, a secondary coil 3, a center core 41, an outer core 42, an igniter 43, a coil case 5 and an electrically-insulative fixation resin (or a resin for electrical insulation and fixation) 6.

In addition, FIG. 1 shows the ignition coil 1 in a state where the electrically-insulative fixation resin 6 has been filled in spaces in the coil case 5, whereas FIG. 3 shows the ignition coil 1 before the electrically-insulative fixation resin 6 is filled into the spaces in the coil case 5.

The primary coil 2 is configured to be supplied with electric power; the electric power supply to the primary coil 2 is selectively permitted and interrupted by a switching element. The secondary coil 3 is arranged outside and coaxially with the primary coil 2. The secondary coil 3 is configured to generate an induced electromotive force upon interruption of the electric power supply to the primary coil 2. The center core 41 is arranged inside the primary coil 2. The outer core 42 is quadrangular ring-shaped to have four parts thereof located respectively on opposite sides L1 and L2 of the secondary coil 3 in an axial direction L of the ignition coil 1 (see FIG. 1) and opposite sides of the secondary coil 3 in a width direction W of the ignition coil 1 (see FIG. 3) perpendicular to the axial direction L. The center core 41 and the outer core 42 together form a closed magnetic circuit in the ignition coil 1.

The igniter 43 includes the switching element. As shown in FIG. 1, the igniter 43 is arranged, on a low-voltage side L2 of the outer core 42 in the axial direction L, adjacent to the outer core 42. The coil case 5 has an opening 52 on one side in a mounting direction D of the ignition coil 1, which is perpendicular to both the axial direction L and the width direction W, and a bottom part 53 on the other side in the mounting direction D. The coil case 5 is configured to receive all of the primary coil 2, the secondary coil 3, the center core 41, the outer core 42 and the igniter 43 therein. The electrically-insulative fixation resin 6 is filled in the spaces in the coil case 5 to fix the primary coil 2, the secondary coil 3, the center core 41, the outer core 42 and the igniter 43 in the coil case 5 while electrically insulating them from each other.

Figure 4:
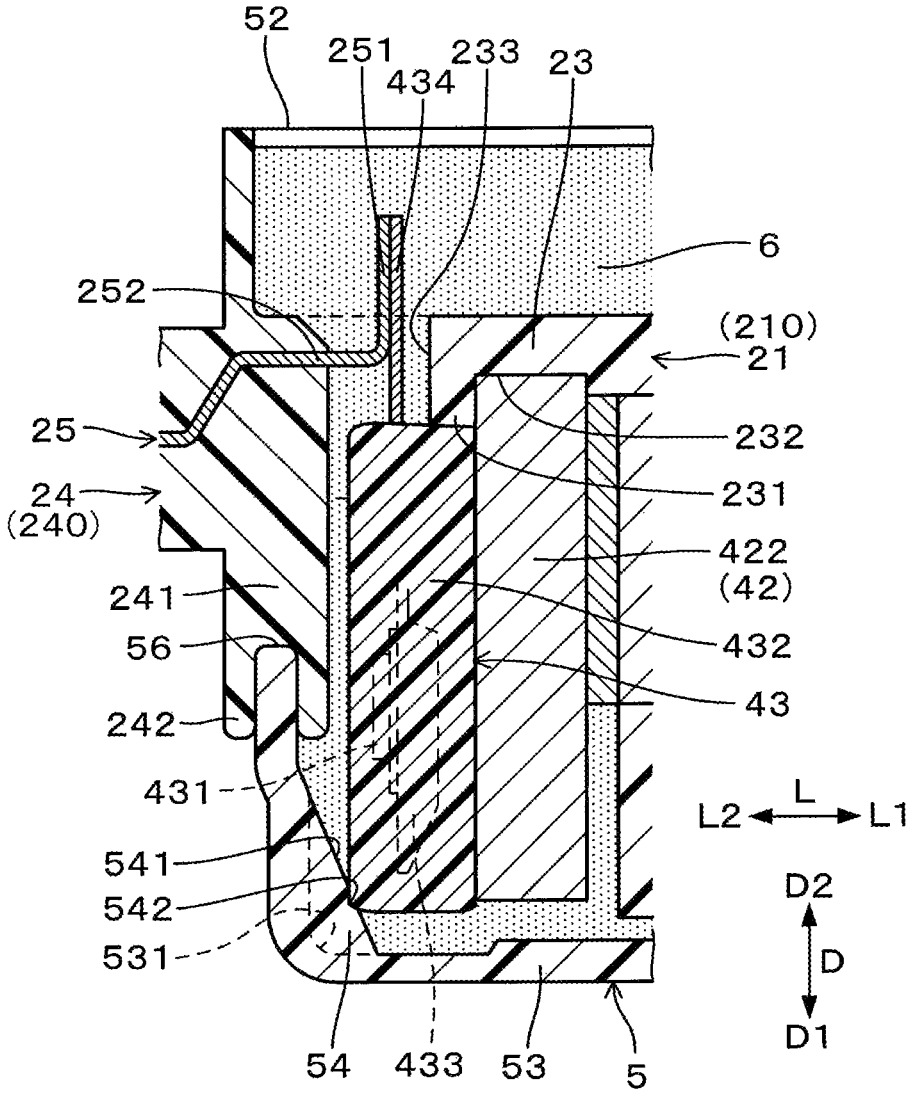
FIG. 4 is an enlarged view of part of FIG. 1 showing a case-side rib formed in the coil case.

As shown in FIG. 4, on an interior surface of the coil case 5 on a bottom side D1 (i.e., the side where the bottom part 53 of the coil case 5 is located) in the mounting direction D, there is formed a case-side rib 54. The case-side rib 54 protrudes from the interior surface of the coil case 5 to a high-voltage side L1 in the axial direction L. Moreover, the case-side rib 54 has a taper shape such that the protruding amount of the case-side rib 54 to the high-voltage side L1 in the axial direction L increases in the mounting direction D toward the bottom side DE Furthermore, the case-side rib 54 is arranged to abut a corner portion of the igniter 43 on the bottom side D1 in the mounting direction D and on the low-voltage side L2 in the axial direction L and thereby press the igniter 43 against the outer core 42.

Next, the configuration of the ignition coil 1 according to the present embodiment will be described in detail.

(Ignition Coil 1)

As shown in FIG. 1, the ignition coil 1 is designed to be mounted to a cylinder head cover 7 of an internal combustion engine of a vehicle and to cause a spark plug (not shown) arranged in a cylinder head to generate a spark discharge in a combustion chamber of the internal combustion engine.

The ignition coil 1 includes a coil main body 11 and a joint part 12. The coil main body 11 is composed of the primary coil 2, the secondary coil 3, the igniter 43, the coil case 5 and the like. The joint part 12 protrudes from the coil main body 11 to electrically connect the secondary coil 3 to the spark plug via a high-voltage terminal 45 and a spring 46. The coil main body 11 is arranged on the cylinder head cover 7, while the joint part 12 is arranged in a plug hole 71 formed in the cylinder head cover 7.

(Axial Direction L, Mounting Direction D and Width Direction W)

In FIGS. 1-7, the axial direction L denotes the direction in which the central axes of the primary coil 2 and the secondary coil 3 extend. Moreover, in the axial direction L, the side where a high voltage is generated in the secondary coil 3 is referred to as the high-voltage side L1; the side opposite to the high-voltage side L1 is referred to as the low-voltage side L2.

The mounting direction D denotes the direction in which a connector 24 is mounted to the coil case 5 (see FIG. 7) and the ignition coil 1 is mounted to the cylinder head cover 7 of the internal combustion engine (see FIG. 1). More specifically, the mounting direction D denotes the direction which is perpendicular to the axial direction L and in which the opening 52 and the bottom part 53 of the coil case 5 are aligned with each other. Moreover, in the mounting direction D, the side where the bottom part 53 and the spark plug are located is referred to as the bottom side D1; the side which is opposite to the bottom side D1 and where the opening 52 is located is referred to an opening side D2.

The width direction W denotes the direction which is perpendicular to both the axial direction L and the mounting direction D.

(Primary Coil 2)

As shown in FIGS. 1-3, the primary coil 2 is formed by winding a magnetic wire (or winding) around an outer circumferential surface of a tubular part 22 of a primary bobbin 21. The electric power supply to the primary coil 2 is selectively permitted and interrupted by the switching element of the igniter 43.

(Secondary Coil 3)

As shown in FIGS. 1-3, the secondary coil 3 is arranged outside and coaxially with the primary coil 2. The secondary coil 3 is formed by winding a magnetic wire (or winding) around an outer circumferential surface of a tubular part 32 of a secondary bobbin 31. The winding constituting the secondary coil 3 is thinner than the winding constituting the primary coil 2; the number of turns of the secondary coil 3 is larger than the number of turns of the primary coil 2. The secondary coil 3 is configured to generate, upon interruption of the electric power supply to the primary coil 2, an induced electromotive force through the inductive interaction between the primary coil 2 and the secondary coil 3. The central axes of the primary coil 2 and the secondary coil 3 are oriented to be perpendicular to the opening 52 of the coil case 5. One end of the secondary coil 3, which is on the low-voltage side L2 in the axial direction L, is connected with a ground or electric power supply terminal of the igniter 43. The other end of the secondary coil 3, which is on the high-voltage side L1 in the axial direction L, is connected with the high-voltage terminal 45 that is connected to a center electrode of the spark plug.

(Center Core 41)

As shown in FIGS. 1-3, the center core 41 is arranged inside the primary coil 2 to allow magnetic flux generated by the primary coil 2 and the secondary coil 3 to flow therethrough. In the present embodiment, the center core 41 is formed by laminating a plurality of magnetic steel sheets made of a soft-magnetic material. Moreover, the center core 41 is shaped in a rectangular cuboid. In addition, the center core 41 may alternatively be formed by compacting powder of a soft-magnetic material.

(Outer Core 42)

As shown in FIGS. 1-3, the outer core 42 is arranged outside the secondary coil 3 to allow the magnetic flux generated by the primary coil 2 and the secondary coil 3 to flow therethrough. In the present embodiment, the outer core 42 is formed by laminating a plurality of magnetic steel sheets made of a soft-magnetic material. Moreover, the outer core 42 is quadrangular ring-shaped so that when viewed along the mounting direction D, the outer core 42 surrounds the primary coil 2, the secondary coil 3 and the center core 41. In addition, the outer core 42 may alternatively be formed by compacting powder of a soft-magnetic material.

The outer core 42 has a pair of side core parts 421 located respectively on opposite sides of the secondary coil 3 in the width direction W (see FIG. 3), and a pair of connection core parts 422 located respectively on the high-voltage and low-voltage sides L1 and L2 of the secondary coil 3 in the axial direction L (see FIG. 2) and each connecting the pair of side core parts 421.

The igniter 43 is arranged to face the connection core part 422 of the outer core 42 which is located on the low-voltage side L2 of the secondary coil 3 in the axial direction L. Between the igniter 43 and the connection core part 422 facing the igniter 43, there is formed almost no gap and thus arranged almost no electrically-insulative fixation resin 6.

The center core 41 and the outer core 42 together form a closed magnetic circuit through which magnetic flux flows. Between the center core 41 and the outer core 42, there is arranged a permanent magnet 44 for preventing magnetic saturation.

(Igniter 43)

As shown in FIGS. 1 and 4, the igniter 43 is arranged between the connector 24 mounted to the coil case 5 and the connection core part 422 of the outer core 42 facing the igniter 43 in the axial direction L.

The igniter 43 includes a circuit forming part 431, a heat sink 432, a mold resin 433 and igniter conductors 434 (i.e., electrical conductors of the igniter 43). The circuit forming part 431 includes electronic components for forming a switching circuit, such as the aforementioned switching element. The heat sink 432 is integrated with the circuit forming part 431 into one piece. The mold resin 433 has both the circuit forming part 431 and the heat sink 432 embedded therein. The igniter conductors 434 extend, from the circuit forming part 431, outside the mold resin 433.

More specifically, the igniter conductors 434 protrude from the mold resin 433 to the opening side D2 in the mounting direction D. The switching element of the igniter 43 is configured to receive a command from an external electronic control device (not shown) arranged outside the ignition coil 1 and to selectively permit and interrupt the electric power supply to the primary coil 2 according to the received command During operation of the ignition coil 1, heat is generated in the igniter 43 mainly by the switching element. The heat generated in the igniter 43 is then dissipated, via the heat sink 432, to the connection core part 422 of the outer core 42 facing the igniter 43.

(Primary Bobbin 21)

As shown in FIGS. 1, 2 and 4, on the outer periphery of the primary bobbin 21, there is wound the primary coil 2. The primary bobbin 21 is constituted of a molded product of a thermoplastic resin. The primary bobbin 21 has an abutting part 231 that abuts an end of the igniter 43 on the opening side D2 in the mounting direction D. The abutting part 231 extends, from an end of the primary bobbin 21 on the low-voltage side L2 in the axial direction L, to the end of the igniter 43 on the opening side D2 in the mounting direction D over the end of the connection core part 422 of the outer core 42 on the opening side D2 in the mounting direction D. The igniter 43 is sandwiched (i.e., fixedly held) between the abutting part 231 of the primary bobbin 21 and the case-side rib 54, thereby being positioned in the mounting direction D in the coil case 5.

As shown in FIG. 2, in the present embodiment, the primary bobbin 21 and a connector part 240 that constitutes the connector 24 are integrally molded as a bobbin-forming molded body 210. More specifically, the bobbin-forming molded body 210 has the quadrangular tubular part 22, a pair of collar portions 221 formed respectively at opposite ends of the tubular part 22 in the axial direction L, the connector part 240 constituting the connector 24, and an interconnection part 23 that interconnects the tubular part 22 and the connector part 240. That is, in the present embodiment, the connector 24 is formed integrally with the primary bobbin 21 into one piece. In addition, the abutting part 231 is included in the interconnection part 23.

As shown in FIG. 4, on the bottom side D1 of the interconnection part 23 in the mounting direction D, there is formed a recess 232 in which the connection core part 422 of the outer core 42 and the igniter 43 are received. Moreover, in the interconnection part 23, there is also formed an insertion hole 233 adjacent to the abutting part 231; through the insertion hole 233, there are inserted the igniter conductors 434 and connector conductors 25 (i.e., electrical conductors of the connector 24). In addition, the connector part 240 constituting the connector 24 may alternatively be formed separately from the tubular part 22 of the primary bobbin 21.

The winding constituting the primary coil 2 is wound around the outer circumferential surface of the tubular part 22 of the primary bobbin 21 between the pair of collar portions 221. In the connector part 240 constituting the connector 24, there are insert-molded the connector conductors 25 that are respectively joined to the igniter conductors 434. The connector part 240 is formed to protrude outside the coil case 5. In the connector part 240 (i.e., the connector 24), there is formed a connector wall portion 241 that constitutes part of a wall of the coil case 5 on the low-voltage side L2 in the axial direction L.

In the coil case 5, the igniter conductors 434 and the connector conductors 25 are arranged at a position on the opening side D2 in the mounting direction D so that the igniter conductors 434 respectively face the connector conductors 25. Moreover, the igniter conductors 434 are respectively joined, for example by soldering or welding, to the connector conductors 25. Furthermore, the igniter conductors 434 are also respectively joined, for example by soldering or welding, to coil conductors connected respectively with opposite ends of the winding constituting the primary coil 2 and a coil conductor connected with a low-voltage-side end of the winding constituting the secondary coil 3.

(Secondary Bobbin 31)

As shown in FIGS. 2 and 3, on the outer periphery of the secondary bobbin 31, there is wound the secondary coil 3.

The secondary bobbin 31 is constituted of a molded product of a thermoplastic resin. The secondary bobbin 31 has the tubular part 32 that is shaped in a quadrangular tube, and a plurality of collar portions 33 formed respectively at a plurality of positions in the axial direction L to protrude from the outer periphery of the tubular part 32. The collar portions 33 partition the outer periphery of the tubular part 32 into a plurality of recesses 321 that are aligned with each other in the axial direction L. The winding constituting the secondary coil 3 is wound on the outer periphery of the tubular part 32 so as to be distributed between the recesses 321.

(Coil Case 5)

Figure 7:
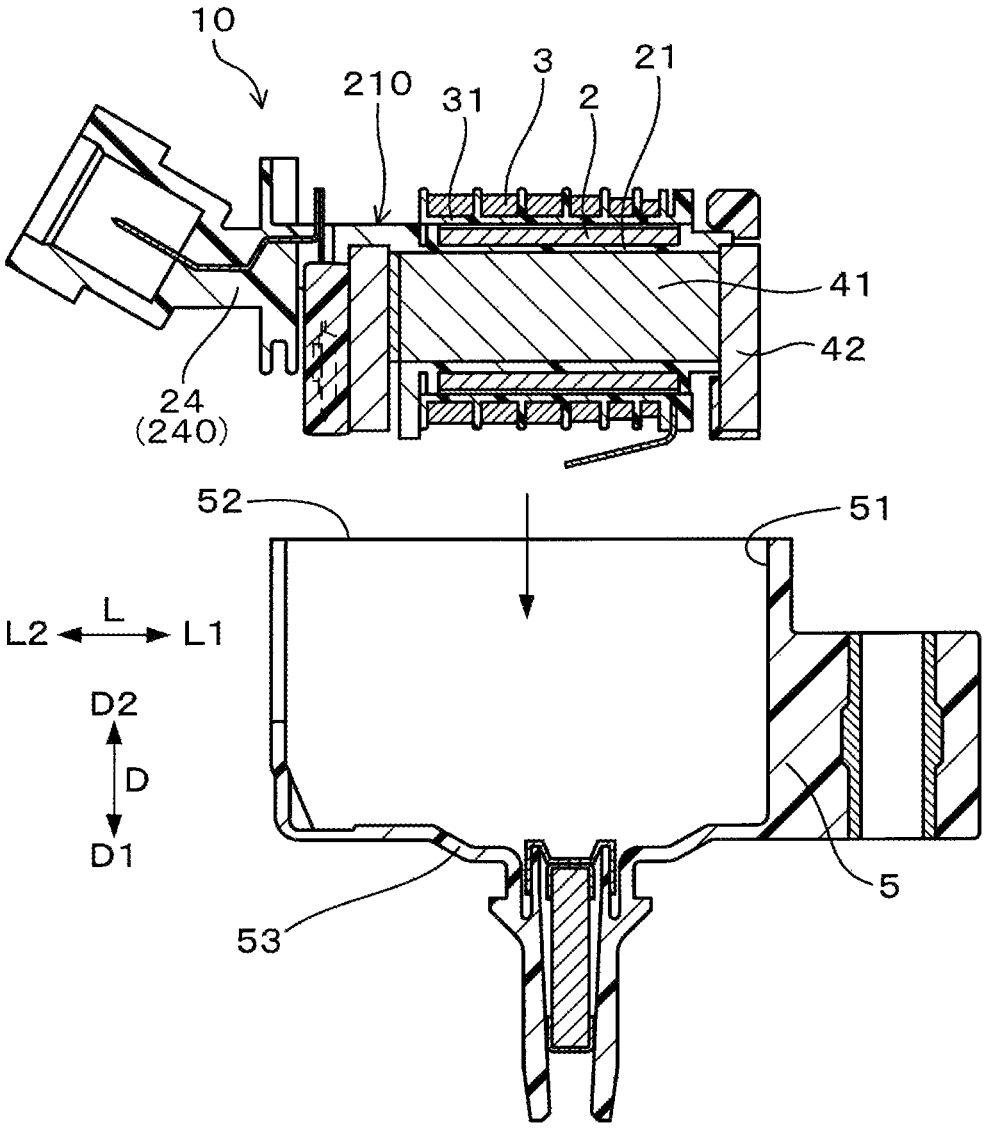
FIG. 7 is an explanatory diagram illustrating the coil assembly in a state of being placed into the coil case.

As shown in FIGS. 1 and 7, the coil case 5 is constituted of a molded product of a thermoplastic resin. The coil case 5 has a receiving part 51 in which are received the primary coil 2, the secondary coil 3, the center core 41, the outer core 42, the igniter 43 and the like. The opening 52 of the coil case 5 is formed at an end of the receiving part 51 on the opening side D2 in the mounting direction D.

During the manufacture of the ignition coil 1, a coil assembly 10, which is obtained by assembling the primary coil 2, the primary bobbin 21, the secondary coil 3, the secondary bobbin 31, the center core 41, the outer core 42 and the igniter 43 together, is placed into the receiving part 51 of the coil case 5 from the opening 52. Then, the electrically-insulative fixation resin 6 in a liquid state is filled into the spaces in the coil case 5 from the opening 52.

On part of the coil case 5, there are arranged the connector part 240 of the bobbin-forming molded body 210 for electrically connecting the igniter 43 to the external electronic control device. The bobbin-forming molded body 210 is obtained by resin insert-molding so as to have the center core 41 located in the tubular part 22 of the primary bobbin 21 and the connector conductors 25 located in the connector part 240.

As shown in FIG. 4, in the coil case 5, there is formed a cut (or recess) 56 to which the connector part 240 of the bobbin-forming molded body 210 is mounted. Consequently, part of the wall of the coil case 5 on the low-voltage side L2 in the axial direction L is constituted of the connector wall portion 241. At ends of the connector wall portion 241 on the bottom side D1 in the mounting direction D and both sides in the width direction W, there are respectively formed retaining portions 242 each of which retains (or sandwiches) one edge portion of the cut 56 of the coil case 5 from both sides thereof.

Moreover, as shown in FIG. 1, on the bottom part 53 of the coil case 5 located on the bottom side D1 in the mounting direction D, there is formed a tower part 57 that constitutes the joint part 12. Further, on the tower part 57, there is mounted a seal rubber 58 for sealing between the ignition coil 1 and the plug hole 71.

(Case-Side Rib 54)

Figure 5:
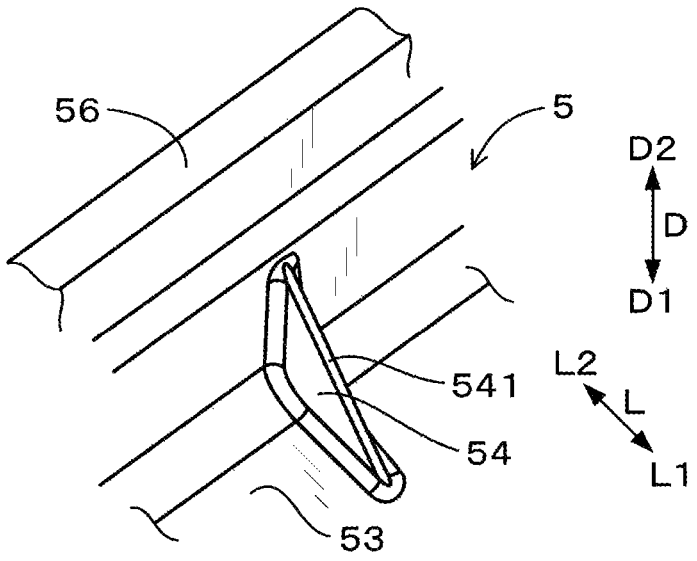
FIG. 5 is a perspective view showing the case-side rib.
Figure 6:
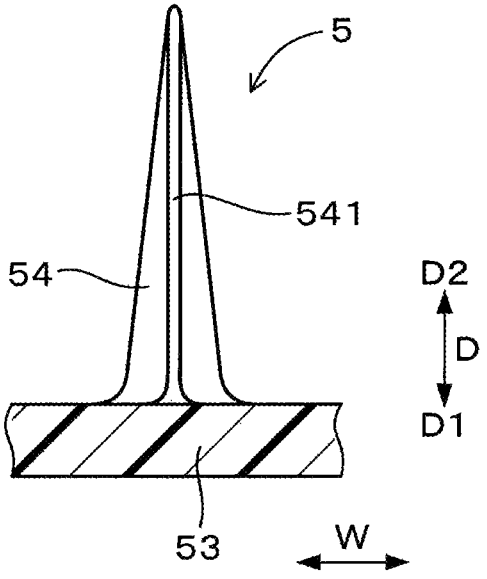
FIG. 6 is a schematic view of the case-side rib along the axial direction.

As shown in FIGS. 4-6, the case-side rib 54 is formed on the interior surface of the coil case 5 which defines an interior corner portion 531 of the coil case 5 on the bottom side D1 in the mounting direction D and on the low-voltage side L2 in the axial direction L. Moreover, when viewed along the width direction W, the case-side rib 54 is triangular-shaped and has an oblique side portion (or distal end portion) 541 that extends obliquely to both the axial direction L and the mounting direction D. Furthermore, the width of the case-side rib 54 in the width direction W decreases as the case-side rib 54 extends from the interior surface of the coil case 5 to the high-voltage side L1 in the axial direction L. Further, the case-side rib 54 is tapered from its root position (i.e., from the interior corner portion 531 of the coil case 5) to the oblique side portion 541. In other words, on any cross section of the case-side rib 54 perpendicular to a line representing a distal edge of the oblique side portion 541, the width of the case-side rib 54 in the width direction W decreases from the interior surface of the coil case 5 to the oblique side portion 541.

As shown in FIG. 4, in the present embodiment, the case-side rib 54 is formed so thin that it can be plastically deformed upon the igniter 43 being brought into abutment with it. More specifically, the case-side rib 54 is formed to have its width in the width direction W smaller than the minimum thickness of the coil case 5. In the coil case 5, the case-side rib 54 is formed at a position such that when the igniter 43 is inserted into the coil case 5 from the opening 52, part of the oblique side portion 541 of the case-side rib 54 will be crushed (or plastically deformed) by the corner portion of the igniter 43 on the bottom side D1 in the mounting direction D and on the low-voltage side L2 in the axial direction L.

With the above configuration, it is possible to press the igniter 43 against the connection core part 422 of the outer core 42 by the case-side rib 54 and reliably keep the igniter 43 in the pressed state.

Figure 8:
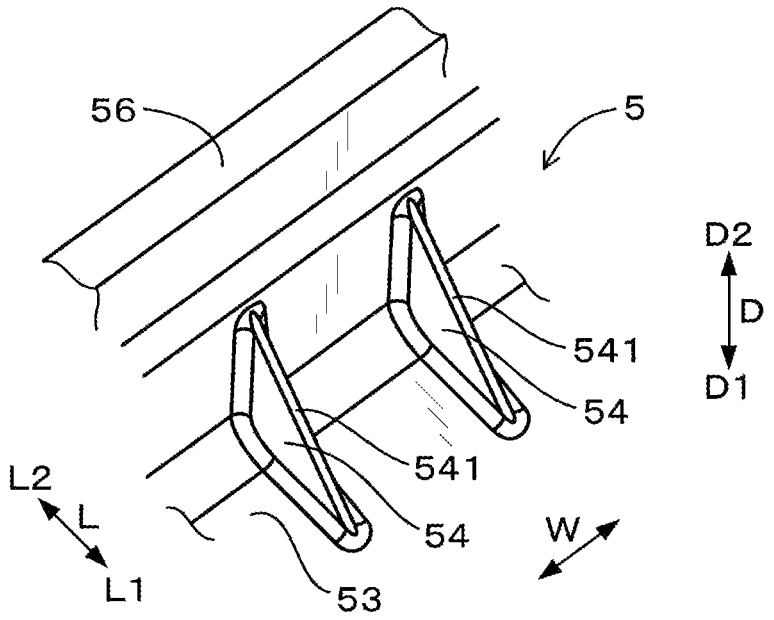
FIG. 8 is a perspective view showing a plurality of case-side ribs formed in a coil case according to a modification of the first embodiment.

In the present embodiment, on the interior corner portion 531 of the coil case 5 on the bottom side D1 in the mounting direction D and on the low-voltage side L2 in the axial direction L, there is formed only one case-side rib 54 at a position corresponding to the center position of the igniter 43 in the width direction W. As an alternative, as shown in FIG. 8, a plurality of case-side ribs 54 may be formed on the interior corner portion 531 of the coil case 5 in alignment with each other in the width direction W.

In addition, the case-side rib(s) 54 may alternatively be formed to have a sufficiently large width in the width direction W and thus sufficiently high rigidity so as to be hardly plastically deformed by the igniter 43.

(Electric Ally-Insulative Fixation Resin 6)

The electrically-insulative fixation resin 6 is formed of a thermosetting resin. Specifically, as shown in FIGS. 1 and 7, during the manufacture of the ignition coil 1, the coil assembly 10, which is obtained by assembling the primary coil 2, the primary bobbin 21, the secondary coil 3, the secondary bobbin 31, the center core 41, the outer core 42 and the igniter 43 together, is placed into the coil case 5. Then, the thermosetting resin in a liquid state is filled into the spaces in the coil case 5 and set in the spaces to form the electrically-insulative fixation resin 6. Consequently, with the electrically-insulative fixation resin 6, all of the primary coil 2, the primary bobbin 21, the secondary coil 3, the secondary bobbin 31, the center core 41, the outer core 42 and the igniter 43 are fixed to one another in the coil case 5; and the primary coil 2, the secondary coil 3, the center core 41, the outer core 42 and the igniter 43 are electrically insulated from each other.

(Gap Between Igniter 43 and Outer Core 42)

It is preferable for the igniter 43 and the connection core part 422 of the outer core 42 facing the igniter 43 to be in intimate contact with each other. Alternatively, between the igniter 43 and the connection core part 422 of the outer core 42 facing the igniter 43, there may be formed a gap smaller than or equal to 0.13 mm Here, 0.13 mm is specified as a value necessary for keeping the temperature of the igniter 43 lower than or equal to 150° C. even when the amount of electric power consumed by the igniter 43 is increased with increase in the output of the ignition coil 1.

(Abutment Between Igniter 43 and Case-Side Rib 54)

The igniter 43 is arranged with respect to the coil assembly 10 where the primary coil 2, the secondary coil 3, the secondary bobbin 31, the center core 41 and the outer core 42 are assembled to the bobbin-forming molded body 210. Further, as shown in FIG. 7, the igniter 43 is placed into the coil case 5 when the connector wall portion 241 of the connector part 240 of the bobbin-forming molded body 210 included in the coil assembly 10 is mounted to the cut 56 of the coil case 5.

As shown in FIG. 4, the igniter 43 abuts the abutting part 231 provided in the interconnection part 23 of the bobbin-forming molded body 210, thereby being restrained from moving to the opening side D2 in the mounting direction D. Moreover, the igniter conductors 434, which protrude from the end of the igniter 43 on the opening side D2 in the mounting direction D, respectively abut the connector conductors 25 of the connector part 240, thereby restricting movement of the igniter 43 to the low-voltage side L2 in the axial direction L.

As shown in FIG. 4, the corner portion of the igniter 43 on the bottom side D1 in the mounting direction D and on the low-voltage side L2 in the axial direction L is brought into abutment with the oblique side portion 541 of the case-side rib 54 when the connector wall portion 241 is mounted to the cut 56 of the coil case 5. Moreover, at this time, the igniter 43 is pressed by the oblique side portion 541 of the case-side rib 54 toward the connection core part 422 of the outer core 42 facing the igniter 43, thereby being brought into abutment with the connection core part 422 of the outer core 42.

Therefore, when the connector wall portion 241 is further moved to the bottom side D1 in the mounting direction D to a final mounting position, part of the oblique side portion 541 of the case-side rib 54 is crushed by the corner portion of the igniter 43 on the bottom side D1 in the mounting direction D and on the low-voltage side L2 in the axial direction L, with the igniter 43 being supported by the abutting part 231 provided in the interconnection part 23 of the bobbin-forming molded body 210. Consequently, an indentation 542 is formed in part of the oblique side portion 541 of the case-side rib 54 by the biting of the igniter 43 thereinto.

(Operational Effects)

In the ignition coil 1 according to the present embodiment, the case-side rib 54 is formed on the interior surface of the coil case 5; the igniter 43 is pressed by the case-side rib 54 against the connection core part 422 of the outer core 42 facing the igniter 43. More particularly, the case-side rib 54 is configured to press an end part of the igniter 43 on the bottom side D1 in the mounting direction D against the connection core part 422 of the outer core 42 so as to keep the end part of the igniter 43 from being separated from the connection core part 422 of the outer core 42.

Moreover, the case-side rib 54 has the taper shape such that the protruding amount of the case-side rib 54 to the high-voltage side L1 in the axial direction L increases in the mounting direction D toward the bottom side D1. The corner portion of the igniter 43 on the bottom side D1 in the mounting direction D and on the low-voltage side L2 in the axial direction L is brought into abutment with the oblique side portion 541 of the case-side rib 54 when the igniter 43 having been assembled to the bobbin-forming molded body 210 is placed into the coil case 5.

At this time, the igniter 43 slides on the oblique side portion 541 of the case-side rib 54, thereby being shifted toward the connection core part 422 of the outer core 42. Consequently, it becomes possible for the igniter 43 to be suitably pressed against the outer core 42. Moreover, the igniter 43, which is pressed against the connection core part 422 of the outer core 42, is kept sandwiched between the abutting part 231 of the primary bobbin 21 and the case-side rib 54 in the coil case 5. As a result, it becomes possible for heat to be more effectively dissipated from the igniter 43 to the outer core 42.

On the other hand, in a conventional ignition coil where no case-side rib 54 is formed in the coil case 5, the igniter 43 may be inclined, in the coil case having the coil assembly 10 arranged therein, with respect to the mounting direction D, causing an end part of the igniter 43 on the bottom side D1 in the mounting direction D to be separated from the connection core part 422 of the outer core 42. In this case, the heat dissipation (or heat transfer) efficiency from the igniter 43 to the connection core part 422 of the outer core 42 would be lowered. In contrast, in the ignition coil 1 according to the present embodiment, the heat dissipation efficiency from the igniter 43 to the connection core part 422 of the outer core 42 can be prevented from being lowered.

To sum up, with the configuration of the ignition coil 1 according to the present embodiment, it becomes possible to improve the heat dissipation efficiency from the igniter 43 to the outer core 42.

Second Embodiment

An ignition coil 1 according to the second embodiment has a similar configuration to the ignition coil 1 according to the first embodiment. Therefore, the differences therebetween will be mainly described hereinafter.

As described previously, in the ignition coil 1 according to the first embodiment, there is the case-side rib 54 formed in the coil case 5.

Figure 9:
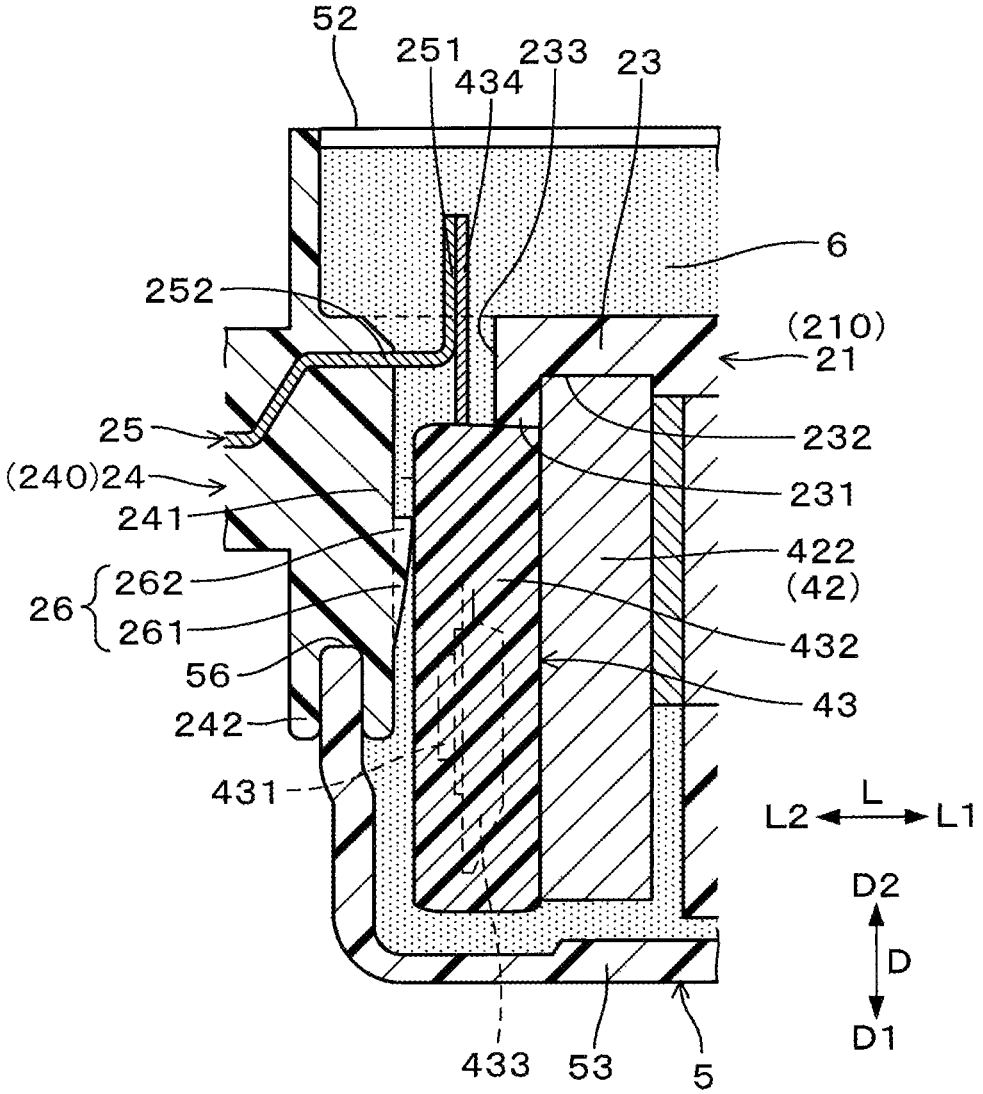
FIG. 9 is an enlarged cross-sectional view, perpendicular to a width direction, of part of an ignition coil according to a second embodiment.
Figure 10:
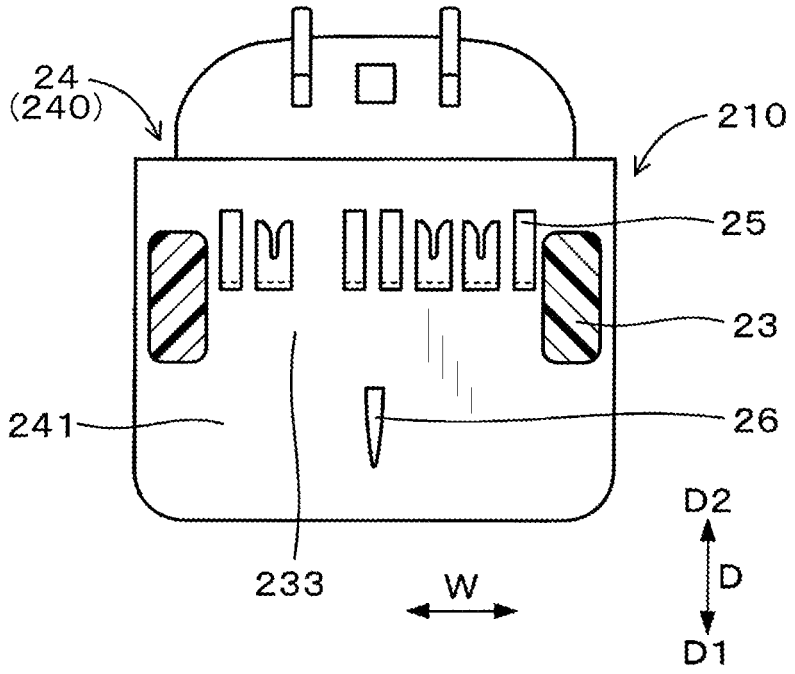
FIG. 10 is a schematic view, along an axial direction, showing a connector-side rib formed in a connector of the ignition coil according to the second embodiment.

In contrast, in the ignition coil 1 according to the present embodiment, as shown in FIGS. 9 and 10, there is no case-side rib 54 formed in the coil case 5. Instead, a connector-side rib 26 is formed in the connector part 240 of the bobbin-forming molded body 210 which constitutes the connector 24. In addition, FIG. 10 shows the connector 24 as viewed from the high-voltage side L1 in the axial direction L.

Figure 11:
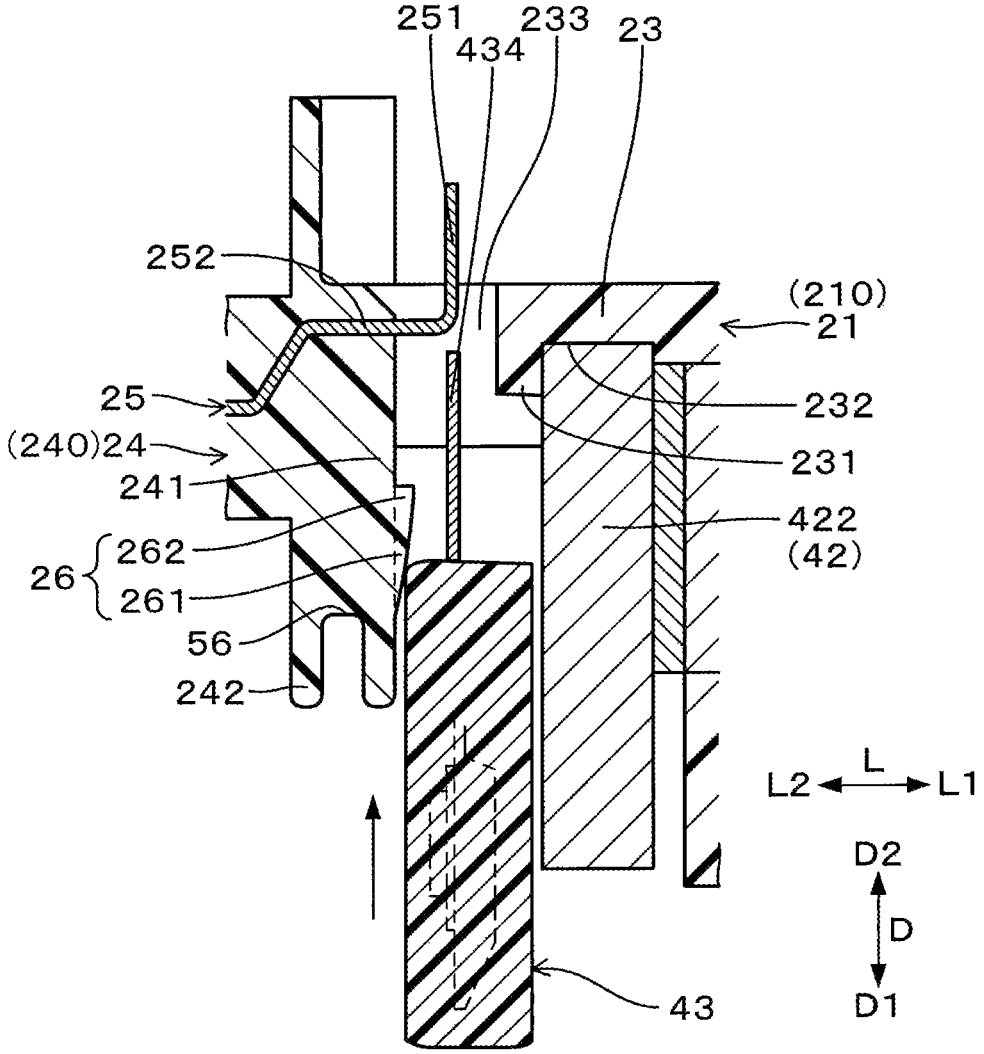
FIG. 11 is an explanatory diagram illustrating an igniter in a state of being assembled to a bobbin-forming molded body, the igniter and the bobbin-forming molded body together constituting part of the ignition coil according to the second embodiment.

In the present embodiment, as shown in FIG. 11, when the igniter 43 is assembled to the bobbin-forming molded body 210 to form the coil assembly 10, the igniter 43 is pressed by the connector-side rib 26 against the connection core part 422 of the outer core 42 facing the igniter 43.

More specifically, in the present embodiment, as shown in FIGS. 9 and 11, the primary bobbin 21 and the connector part 240 that constitutes the connector 24 are integrally molded as the bobbin-forming molded body 210 as in the first embodiment. On an interior surface of the connector wall portion 241 of the connector part 240, there is formed the connector-side rib 26 for pressing the igniter 43 against the outer core 42. The connector-side rib 26 has a taper part 261 and a straight part 262. The taper part 261 is tapered such that the protruding amount of the taper part 261 from the interior surface of the connector wall portion 241 to the high-voltage side L1 in the axial direction L increases in the mounting direction D toward the opening side D2. The straight part 262 is formed on the opening side D2 of and continuously with the taper part 261. The straight part 262 is shaped straight such that the protruding amount of the straight part 262 from the interior surface of the connector wall portion 241 to the high-voltage side L1 in the axial direction L is constant in the mounting direction D.

Moreover, in the present embodiment, the taper part 261 of the connector-side rib 26 is formed to have its width in the width direction W decreasing in the mounting direction D toward the bottom side DE As shown in FIG. 10, on the interior surface of the connector wall portion 241, there is formed only one connector-side rib 26 at a position corresponding to the center position of the igniter 43 in the width direction W. As an alternative, though not shown in the drawings, a plurality of connector-side ribs 26 may be formed on the interior surface of the connector wall portion 241 in alignment with each other in the width direction W. In addition, the connector-side rib(s) 26 may alternatively be formed to have no straight part 262, i.e., have only the taper part 261.

(Abutment Between Igniter 43 and Connector-Side Rib 26)

In the present embodiment, as shown in FIG. 11, the igniter 43 is assembled to the bobbin-forming molded body 210 to form the coil assembly 10; the bobbin-forming molded body 210 has the primary coil 2, the secondary coil 3, the secondary bobbin 31, the center core 41 and the outer core 42 already assembled thereto. More specifically, the igniter 43 is assembled to the bobbin-forming molded body 210 by being inserted into the recess 232 formed in the bobbin-forming molded body 210. During the insertion of the igniter 43 into the recess 232, a corner portion of the igniter 43 on the opening side D2 in the mounting direction D and on the low-voltage side L2 in the axial direction L is brought into abutment with the taper part 261 of the connector-side rib 26.

Moreover, at this time, the igniter 43 is pressed by the taper part 261 of the connector-side rib 26 toward the connection core part 422 of the outer core 42 facing the igniter 43, thereby being brought into abutment with the connection core part 422 of the outer core 42. Then, with further movement of the igniter 43 to the opening side D2 in the mounting direction D, a side surface of the igniter 43 is brought into abutment with the straight part 262 of the connector-side rib 26, thereby keeping the igniter 43 in a state of being pressed against the connection core part 422 of the outer core 42.

Furthermore, the igniter 43 is brought into abutment with the abutting part 231 provided in the interconnection part 23 of the bobbin-forming molded body 210, thereby being restrained from moving to the opening side D2 in the mounting direction D. Thereafter, the coil assembly 10 having the igniter 43 assembled to the bobbin-forming molded body 210 is placed into the receiving part 51 of the coil case 5 when the connector wall portion 241 of the connector part 240 of the bobbin-forming molded body 210 is mounted to the cut 56 of the coil case 5 (see FIG. 9).

(Operational Effects)

In the ignition coil 1 according to the present embodiment, the connector-side rib 26 is formed on the interior surface of the connector wall portion 241 of the connector part 240 that constitutes the connector 24; the connector wall portion 241 is mounted to the coil case 5. The igniter 43 is pressed by the connector-side rib 26 against the connection core part 422 of the outer core 42 facing the igniter 43. The connector-side rib 26 has the taper part 261 tapered such that the protruding amount of the taper part 261 from the interior surface of the connector wall portion 241 to the high-voltage side L1 in the axial direction L increases in the mounting direction D toward the opening side D2. The igniter 43 is brought into abutment with the taper part 261 of the connector-side rib 26 when the igniter 43 is assembled to the bobbin-forming molded body 210 to form the coil assembly 10.

At this time, the igniter 43 slides on the taper part 261 of the connector-side rib 26, thereby being shifted toward the connection core part 422 of the outer core 42. Consequently, it becomes possible for the igniter 43 to be suitably pressed against the outer core 42. Moreover, the igniter 43, which is pressed against the connection core part 422 of the outer core 42, is kept sandwiched between the abutting part 231 of the primary bobbin 21 and the connector-side rib 26 in the coil case 5. As a result, it becomes possible for heat to be more effectively dissipated from the igniter 43 to the outer core 42.

To sum up, with the configuration of the ignition coil 1 according to the present embodiment, it becomes possible to improve the heat dissipation efficiency from the igniter 43 to the outer core 42.

Figure 12:
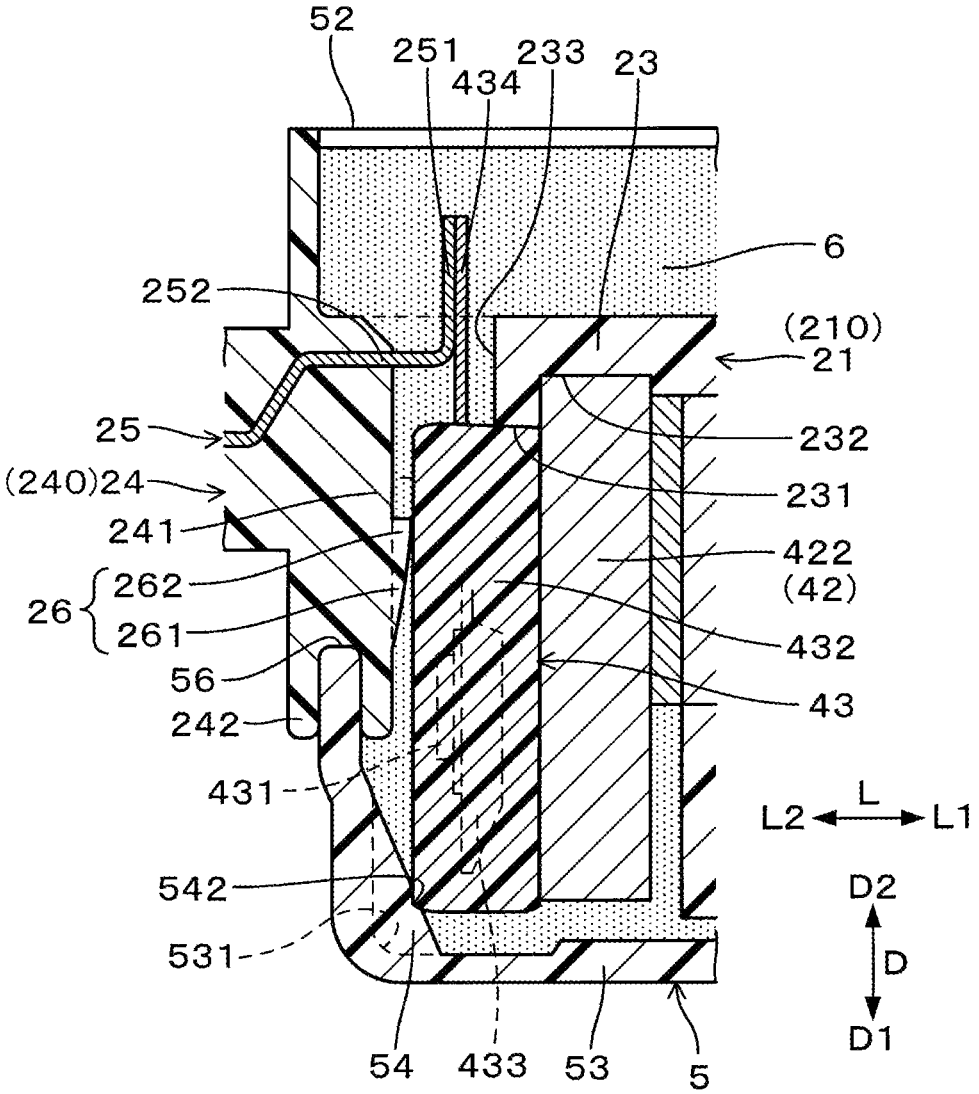
FIG. 12 is an enlarged cross-sectional view, perpendicular to a width direction, of part of an ignition coil according to a modification of the second embodiment.

In addition, as shown in FIG. 12, the ignition coil 1 according to the present embodiment may be modified to further have a case-side rib 54 formed in the coil case 5. In this case, the igniter 43 would be pressed by both the connector-side rib 26 and the case-side rib 54 against the connection core part 422 of the outer core 42 facing the igniter 43. Consequently, it would become possible to more effectively place the igniter 43 and the connection core part 422 of the outer core 42 in intimate contact with each other.

Third Embodiment

An ignition coil 1 according to the third embodiment has a similar configuration to the ignition coils 1 according to the first and second embodiments. Therefore, the differences therebetween will be mainly described hereinafter.

As described previously, in the ignition coils 1 according to the first and second embodiments, the connector 24 is formed integrally with the primary bobbin 21 into one piece.

Figure 13:
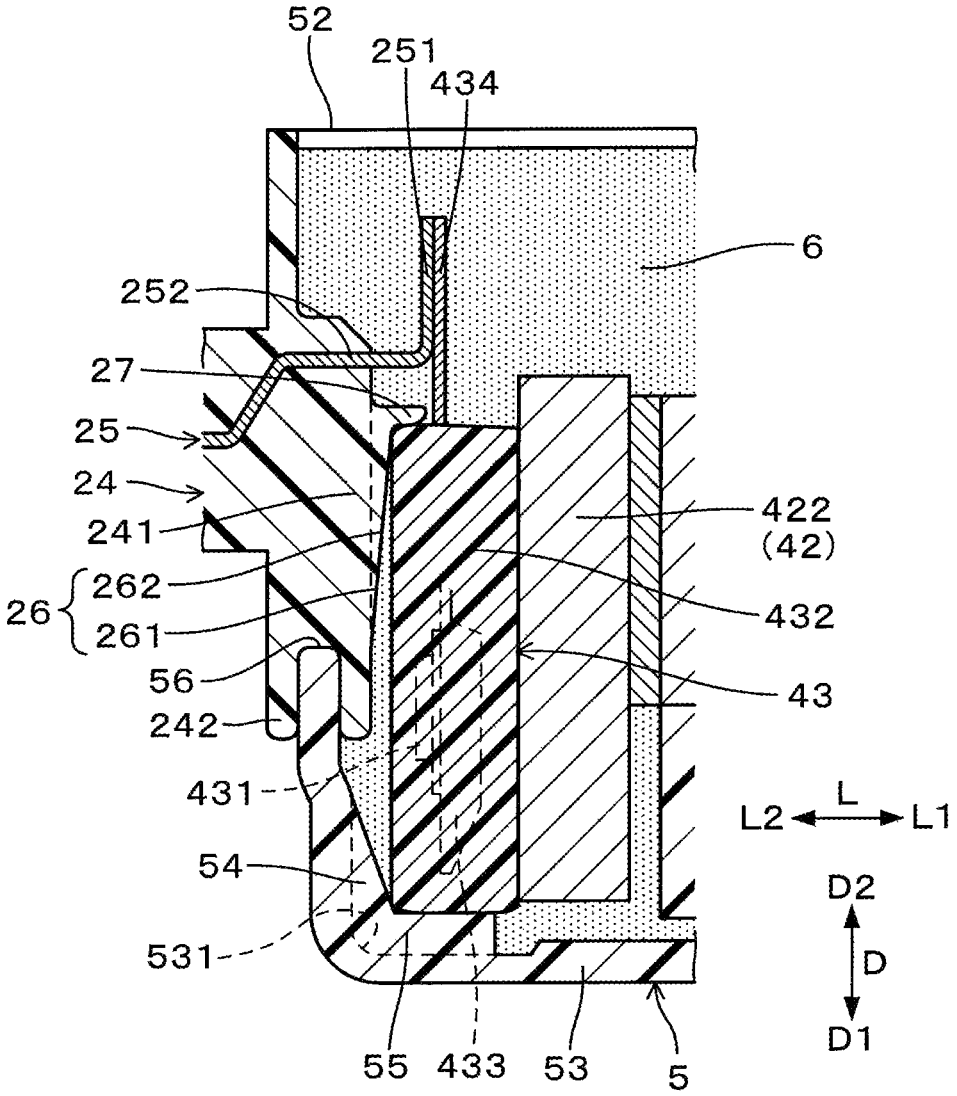
FIG. 13 is an enlarged cross-sectional view, perpendicular to a width direction, of part of an ignition coil according to a third embodiment.

In contrast, in the ignition coil 1 according to the present embodiment, as shown in FIG. 13, the connector 24 is formed separately from the primary bobbin 21.

Figure 14:
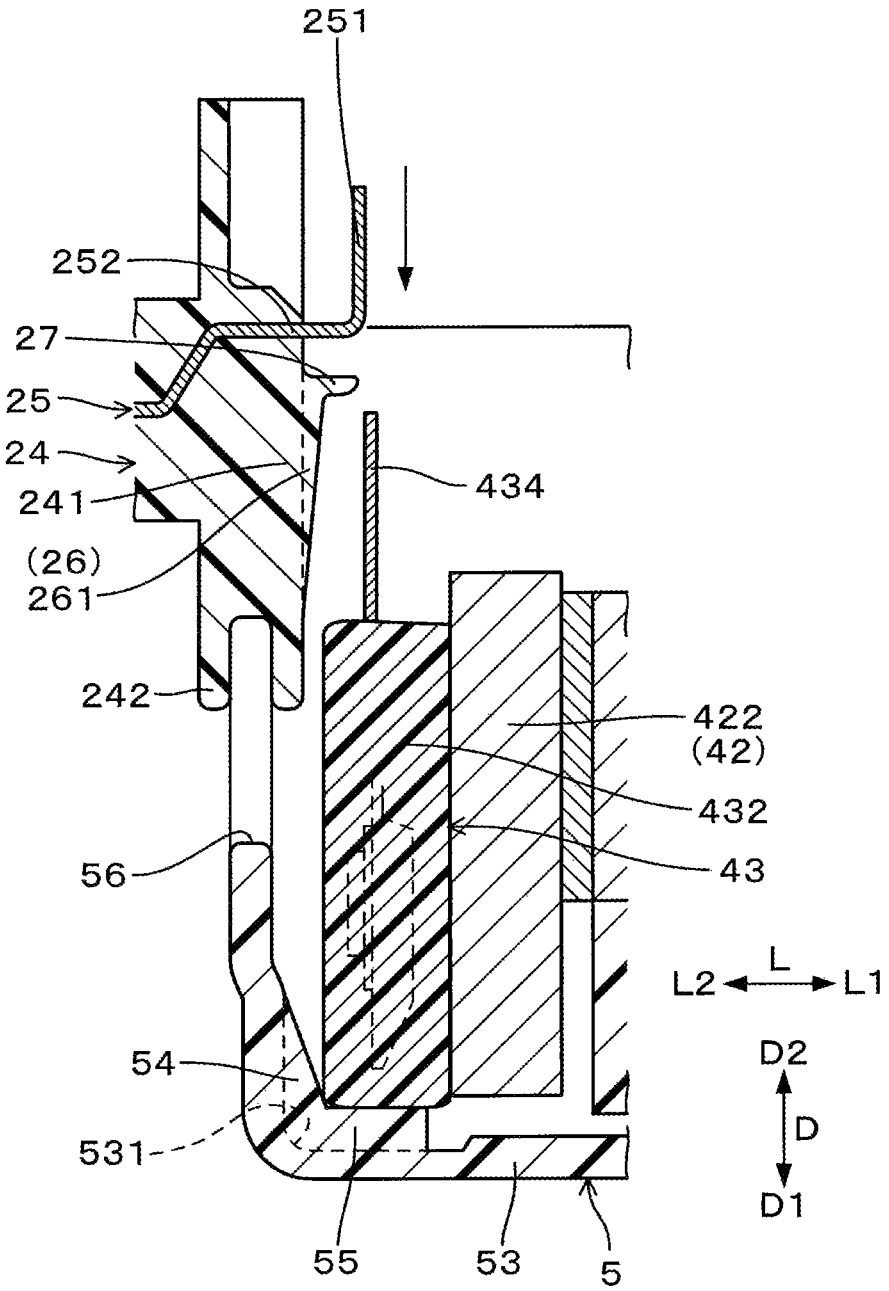
FIG. 14 is an explanatory diagram illustrating a connector in a state of being assembled to a coil case, the connector and the coil case together constituting part of the ignition coil according to the third embodiment.

Moreover, in the present embodiment, as shown in FIG. 14, when the connector wall portion 241 of the connector 24 is mounted to the cut 56 of the coil case 5 that has the igniter 43, the outer core 42 and the like already placed therein, the igniter 43 is pressed by the connector 24 against the connection core part 422 of the outer core 42 facing the igniter 43.

More specifically, in the present embodiment, as shown in FIG. 13, on the interior surface of the connector wall portion 241 of the connector 24, there is formed the connector-side rib 26 as in the second embodiment. The connector wall portion 241 is mounted to the cut 56 of the coil case 5 to form part of the coil case 5. Moreover, in the present embodiment, on the interior surface of the connector wall portion 241, there is also formed an abutting part 27 that abuts the end of the igniter 43 on the opening side D2 in the mounting direction D.

The abutting part 27 is formed continuously with the connector-side rib 26. More specifically, the abutting part 27 is formed, on the opening side D2 of the connector-side rib 26 in the mounting direction D, immediately adjacent to the connector-side rib 26. With the abutting part 27, movement of the igniter 43 to the opening side D2 in the mounting direction D can be restrained. It should be noted that the abutting part 27 may alternatively be formed separately from the connector-side rib 26. In addition, there may be formed a plurality of abutting parts 27 in alignment with each other in the width direction W.

In the present embodiment, as shown in FIG. 13, on the interior surface of the coil case 5 which defines the interior corner portion 531 of the coil case 5 on the bottom side D1 in the mounting direction D and on the low-voltage side L2 in the axial direction L, there is formed the case-side rib 54 as in the first embodiment. The case-side rib 54 is shaped so as not to be plastically deformed by the igniter 43. Moreover, in the present embodiment, on an interior surface of the bottom part 53 of the coil case 5, there is formed an abutting part 55 continuously with the case-side rib 54 to abut the end of the igniter 43 on the bottom side D1 in the mounting direction D. It should be noted that the abutting part 55 may alternatively be formed separately from the case-side rib 54. In addition, there may be formed a plurality of abutting parts 55 in alignment with each other in the width direction W.

With the abutting part 55 formed in the coil case 5, it is possible to support the igniter 43 from the bottom side D1 in the mounting direction D. The igniter 43 is sandwiched between the abutting part 27 of the connector 24 and the abutting part 55 of the coil case 5, thereby being positioned in the mounting direction D in the coil case 5.

It should be noted that the abutting part 55 may also be formed in the coil case 5 of the ignition coil 1 according to the first embodiment where the primary bobbin 21 and the connector 24 are integrally molded as the bobbin-forming molded body 210.

(Abutment Between Igniter 43 and Connector-Side Rib 26)

In the present embodiment, the igniter 43 is placed, along with the coil assembly 10 where the primary coil 2, the secondary coil 3, the secondary bobbin 31, the center core 41 and the outer core 42 are assembled to the bobbin-forming molded body 210, into the coil case 5. Then, as shown in FIG. 14, the connector wall portion 241 of the connector 24 is mounted to the cut 56 of the coil case 5.

At this time, the corner portion of the igniter 43 on the opening side D2 in the mounting direction D and on the low-voltage side L2 in the axial direction L is brought into abutment with the taper part 261 of the connector-side rib 26. Further, the igniter 43 is pressed by the taper part 261 of the connector-side rib 26 toward the connection core part 422 of the outer core 42 facing the igniter 43, thereby being brought into abutment with the connection core part 422 of the outer core 42. Then, with further movement of the connector wall portion 241 of the connector 24 to the bottom side D1 in the mounting direction D, both the abutting part 27 of the connector 24 and the abutting part 55 of the coil case 5 are brought into abutment with the igniter 43. Consequently, the igniter 43 is positioned in the mounting direction D in the coil case 5 and kept in a state of being pressed against the connection core part 422 of the outer core 42 facing the igniter 43.

The ignition coil 1 according to the present embodiment has the same operational effects as the ignition coils 1 according to the first and second embodiments.

Fourth Embodiment

FIGS. 15-24 illustrate ignition coils 1 according to the fourth embodiment. In these ignition coils 1, for each joined pair of the igniter conductors 434 (i.e., electrical conductors of the igniter 43) and the connector conductors 25 (i.e., electrical conductors of the connector 24), at least one of the igniter conductor 434 and the connector conductor 25 of the joined pair has an elastically-deformable portion 435 or 253 formed therein.

Specifically, each of the igniter conductors 434 protrudes, from an end of the mold resin 433 of the igniter 43 on the opening side D2 in the mounting direction D, to the opening side D2 in the mounting direction D. On the other hand, each of the connector conductors 25 has one end protruding from the connector part 240 of the bobbin-forming molded body 210 outward of the coil case 5 and the other end protruding from the connector part 240 inward of the coil case 5 (see FIGS. 1 and 2).

Moreover, each of the connector conductors 25 faces a corresponding one of the igniter conductors 434 in the axial direction L and is joined to the corresponding igniter conductor 434. For each corresponding pair of the connector conductors 25 and the igniter conductors 434, at least one of the connector conductor 25 and the igniter conductor 434 of the corresponding pair is formed to be slightly inclined to a direction in which they approach each other, so as to make it easy to place them in intimate contact with each other.

Figure 15:
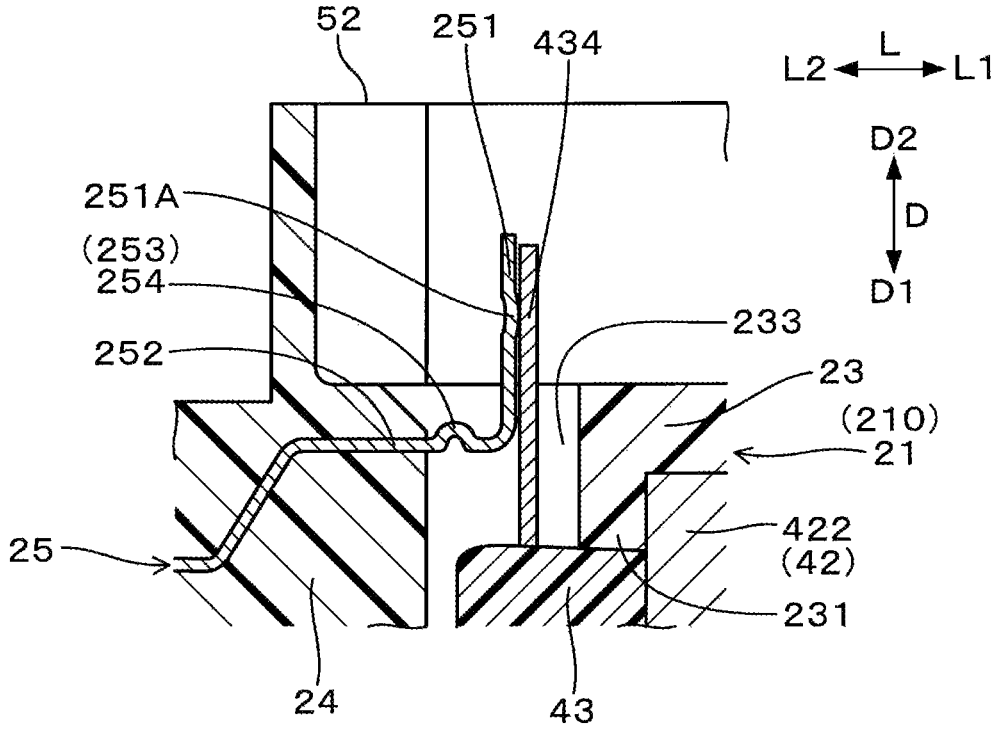
FIG. 15 is an enlarged cross-sectional view, perpendicular to a width direction, of part of a first ignition coil according to a fourth embodiment.

FIG. 15 shows part of an ignition coil 1 according to the present embodiment. In this ignition coil 1, each of the connector conductors 25 has an elastically-deformable portion 253 formed therein. The elastically-deformable portion 253 is constituted of a turn portion 254 that is substantially U-shaped and has an elastically-deformable spring structure. More specifically, each of the connector conductors 25 is formed of an electrically-conductive plate-shaped material. A part of the plate-shaped material is folded back in a thickness direction perpendicular to the plate surfaces, forming the turn portion 254. Each of the connector conductors 25 is bent to have a facing part 251 that faces the corresponding igniter conductor 434 and a non-facing part 252 that extends perpendicular to the facing part 251 and does not face the corresponding igniter conductor 434. The turn portion 254 is formed in the non-facing part 252. In addition, in the facing part 251, there is formed a convex portion 251A that makes contact with the igniter conductor 434.

Figure 16:
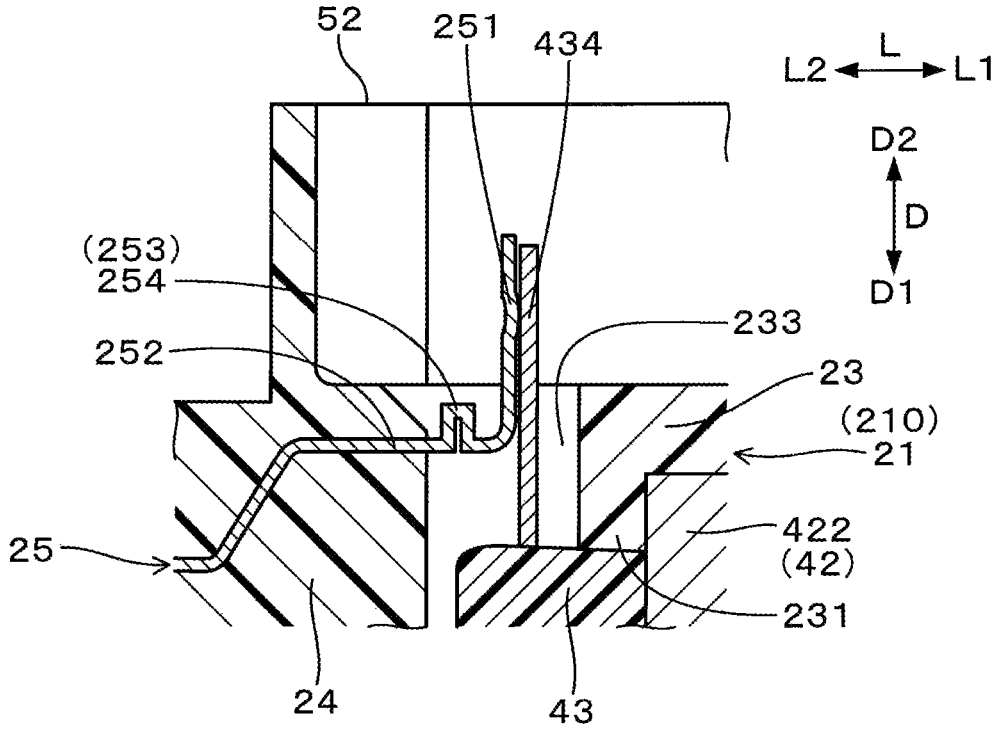
FIG. 16 is an enlarged cross-sectional view, perpendicular to a width direction, of part of a second ignition coil according to the fourth embodiment.
Figure 17:
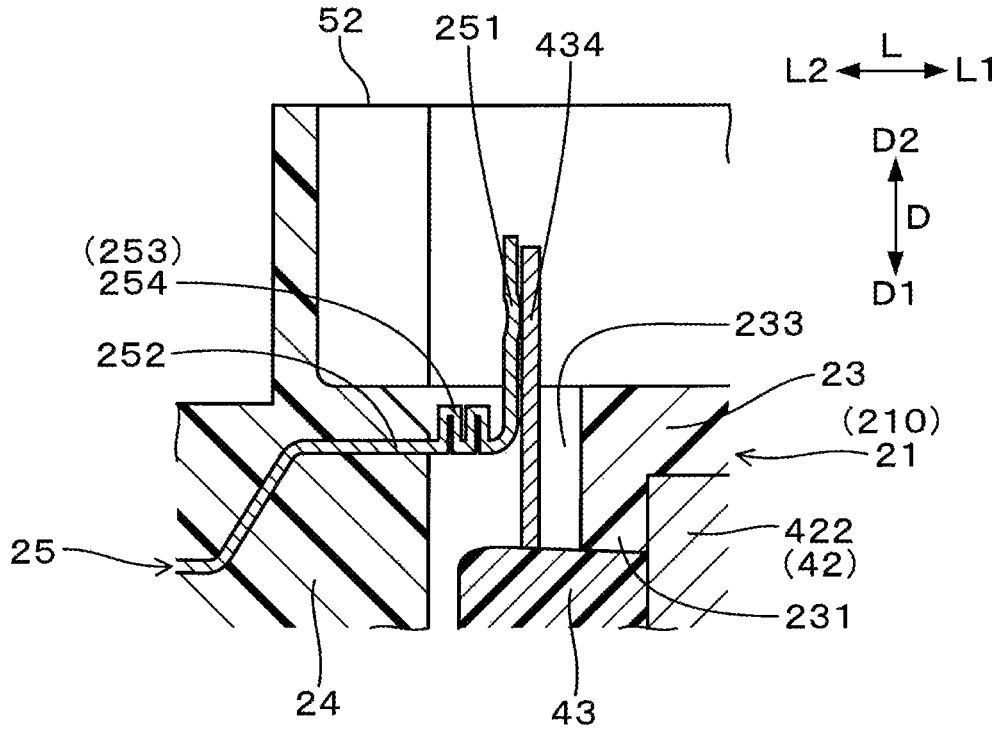
FIG. 17 is an enlarged cross-sectional view, perpendicular to a width direction, of part of a third ignition coil according to the fourth embodiment.

The turn portion 254 may be curved as shown in FIG. 15 or be folded back to have a pair of parallel sections as shown in FIG. 16. As another alternative, the turn portion 254 may be folded back more than once to have more than two parallel sections as shown in FIG. 17.

Figure 18:
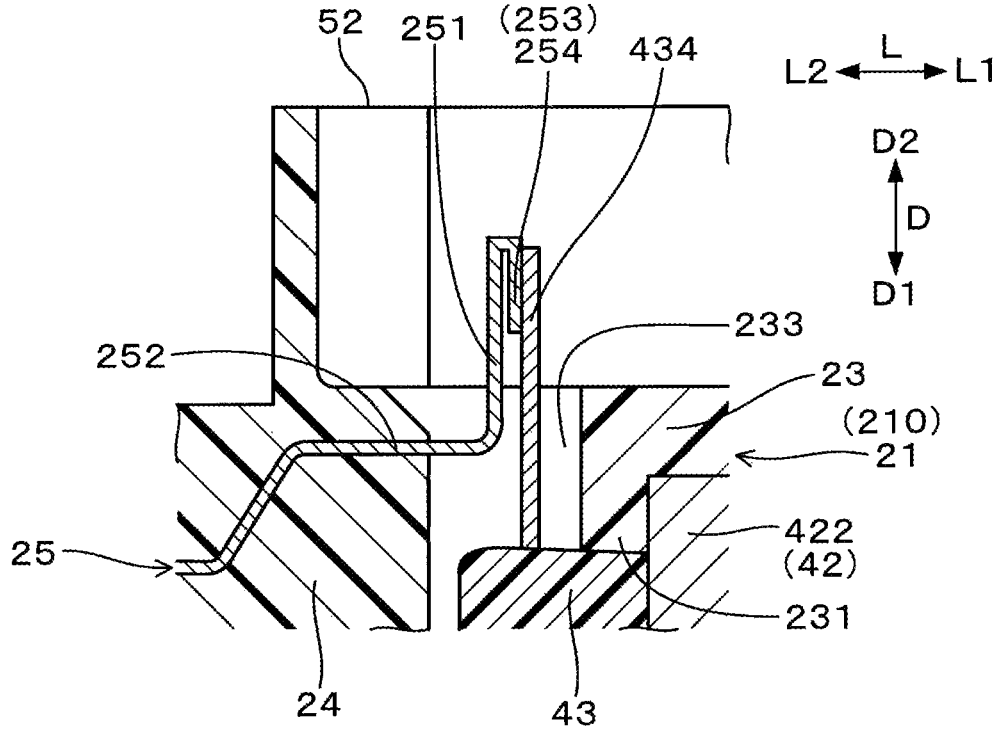
FIG. 18 is an enlarged cross-sectional view, perpendicular to a width direction, of part of a fourth ignition coil according to the fourth embodiment.

As shown in FIG. 18, the turn portion 254 may alternatively be formed by folding back a distal end portion of the facing part 251. Moreover, in this case, the turn portion 254 may be formed to have two or more sections parallel to the corresponding igniter conductor 434.

Figure 19:
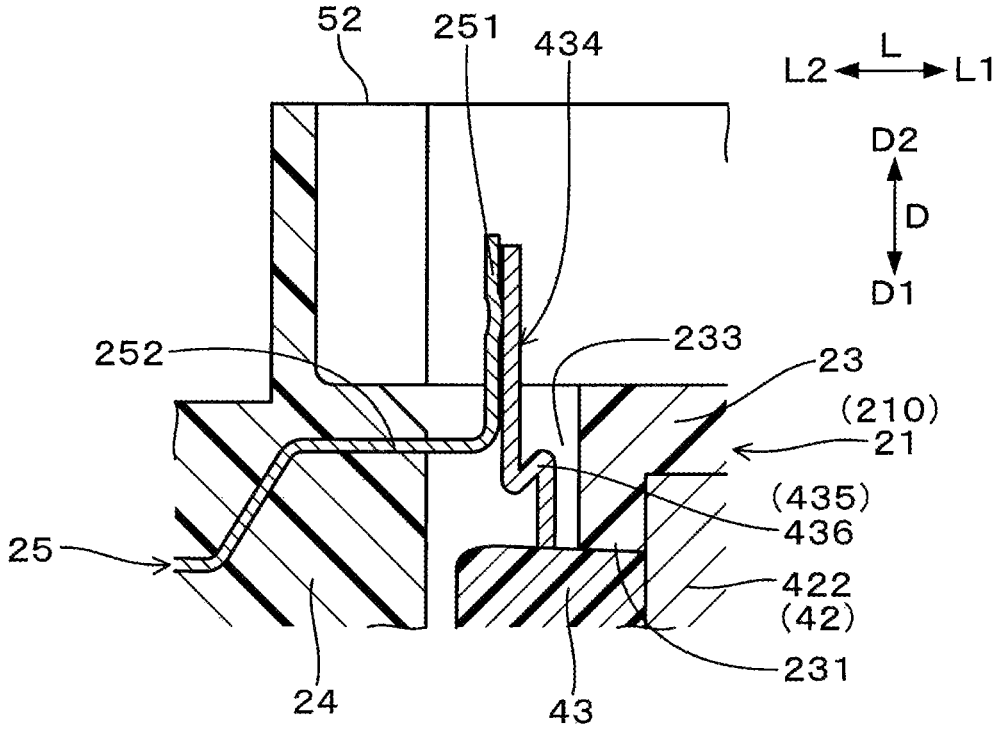
FIG. 19 is an enlarged cross-sectional view, perpendicular to a width direction, of part of a fifth ignition coil according to the fourth embodiment.

FIG. 19 shows part of another ignition coil 1 according to the present embodiment. In this ignition coil 1, each of the igniter conductors 434 has an elastically-deformable portion 435 formed therein. The elastically-deformable portion 435 is constituted of a bent portion 436 that is substantially Z-shaped and has an elastically-deformable spring structure. More specifically, each of the igniter conductors 434 is formed of an electrically-conductive plate-shaped material. A part of the plate-shaped material is folded back in a thickness direction perpendicular to the plate surfaces, forming the bent portion 436. Moreover, the bent portion 436 is formed to offset, to the low-voltage side L2 in the axial direction L, the position where the igniter conductor 434 protrudes from the end of the igniter 43 on the opening side D2 in the mounting direction D.

The ignition coil 1 shown in FIG. 19 may be modified such that each of the connector conductors 25 has an elastically-deformable portion 253 (or turn portion 254)

formed therein as shown in FIGS. 15-18 while each of the igniter conductors 434 has the elastically-deformable portion 435 (or bent portion 436) formed therein.

Figure 20:
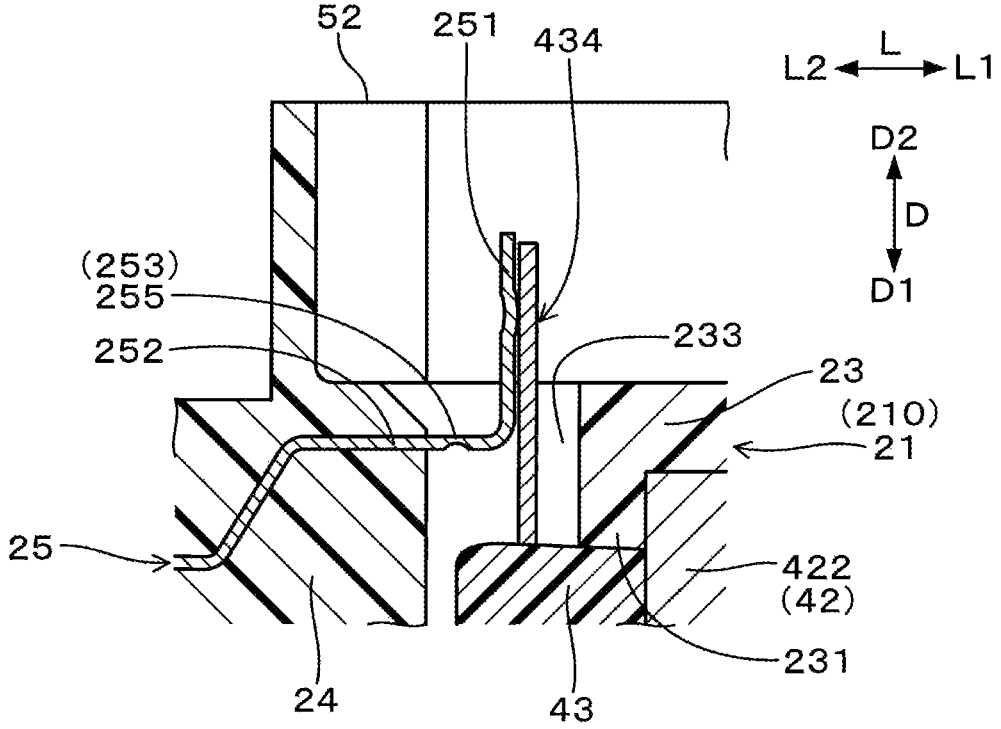
FIG. 20 is an enlarged cross-sectional view, perpendicular to a width direction, of part of a sixth ignition coil according to the fourth embodiment.

As shown in FIG. 20, the elastically-deformable portion 253 may alternatively be constituted of a narrowed portion 255 where the thickness and thus the cross-sectional area of the connector conductor 25 are reduced. The narrowed portion 255 can make up the starting point of elastic deformation of the connector conductor 25 since the thickness and thus the cross-sectional area of the connector conductor 25 are smallest at the narrowed portion 255. Moreover, in this case, the narrowed portion 255 may be formed in the non-facing part 252 of the connector conductor 25 which extends perpendicular to the facing part 251 and does not face the corresponding igniter conductor 434. In addition, the narrowed portion 255 may be obtained by reducing the thickness of a part of the plate-shaped material forming the connector conductor 25.

Figure 21:
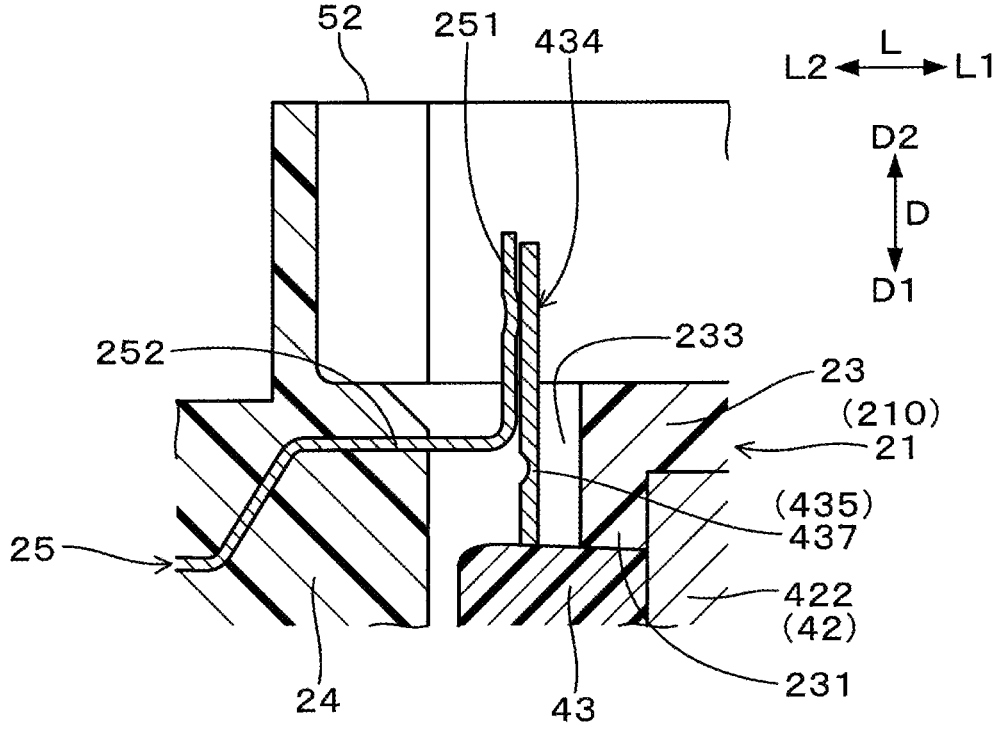
FIG. 21 is an enlarged cross-sectional view, perpendicular to a width direction, of part of a seventh ignition coil according to the fourth embodiment.
Figure 22:
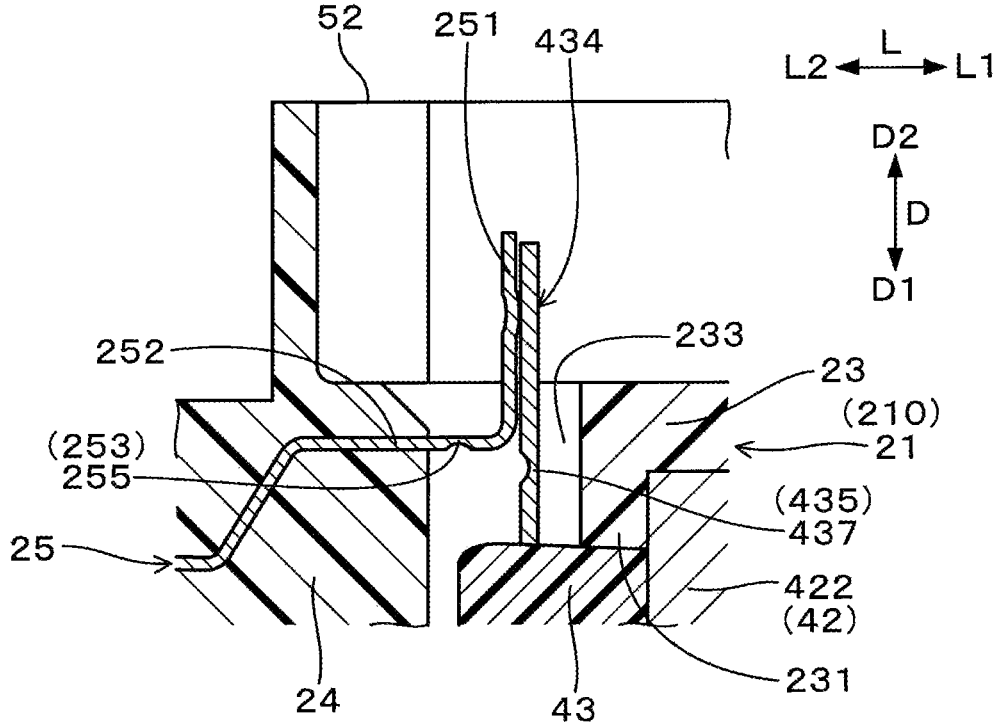
FIG. 22 is an enlarged cross-sectional view, perpendicular to a width direction, of part of an eighth ignition coil according to the fourth embodiment.

As shown in FIG. 21, the elastically-deformable portion 435 may alternatively be constituted of a narrowed portion 437 where the thickness and thus the cross-sectional area of the igniter conductor 434 are reduced. Moreover, as shown in FIG. 22, the elastically-deformable portion 253 may be constituted of a narrowed portion 255 while the elastically-deformable portion 435 is constituted of a narrowed portion 437.

Figure 23:
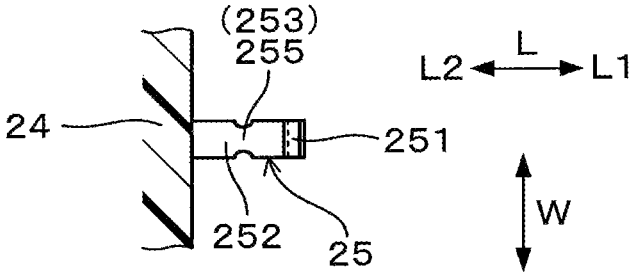
FIG. 23 is an enlarged cross-sectional view, perpendicular to a mounting direction, of part of a ninth ignition coil according to the fourth embodiment.

As shown in FIG. 23, the narrowed portion 255 may alternatively be obtained by reducing the width of a part of the plate-shaped material forming the non-facing part 252 of the connector conductor 25. In addition, FIG. 23 shows part of the ignition coil 1 as viewed from the opening side D2 in the mounting direction D.

Figure 24:
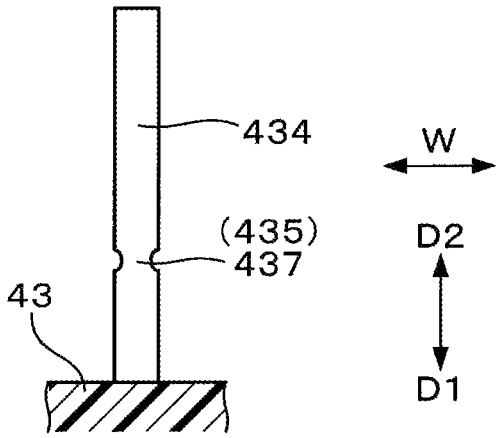
FIG. 24 is an enlarged cross-sectional view, perpendicular to an axial direction, of part of a tenth ignition coil according to the fourth embodiment.

As shown in FIG. 24, the narrowed portion 437 may alternatively be obtained by reducing the width of a part of the plate-shaped material forming the igniter conductor 434. In addition, FIG. 24 shows part of the ignition coil 1 as viewed from the high-voltage side L1 in the axial direction L.

(Operational Effects)

When the igniter 43 is pressed by the case-side rib 54 or the connector-side rib 26 against the connection core part 422 of the outer core 42 facing the igniter 43, stress will be induced in contacting portions of each corresponding pair of the connector conductors 25 and the igniter conductors 434. At this time, for each corresponding pair of the connector conductors 25 and the igniter conductors 434, the elastically-deformable portion 253 of the connector conductor 25 and/or the elastically-deformable portion 435 of the igniter conductor 434 will be elastically deformed, thereby reducing the stress induced in the contacting portions of the connector conductor 25 and the igniter conductor 434. Consequently, it becomes possible to prevent unnecessary stress from being induced in the circuit forming part 431 of the igniter 43 during the assembly of the ignition coil 1; the circuit forming part 431 includes the switching element.

It should be noted that the elastically-deformable portions 253 and 435 described above may also be formed in the connector conductors 25 and the igniter conductors 434 of the ignition coil 1 according to the third embodiment where the connector 24 is formed separately from the primary bobbin 21. In addition, each of the connector conductors 25 may have both a turn portion 254 and a narrowed portion 255 as elastically-deformable portions 253 thereof. Similarly, each of the igniter conductors 434 may have both a bent portion 436 and a narrowed portion 437 as elastically-deformable portions 435 thereof.

While the above particular embodiments and modifications have been shown and described, it will be understood by those skilled in the art that various further modifications, changes, and improvements may be made without departing from the spirit of the present disclosure.

What is claimed is:

1. An ignition coil for an internal combustion engine, the ignition coil comprising:

a primary coil configured to be supplied with electric power;

a secondary coil arranged outside and coaxially with the primary coil, the secondary coil being configured to generate an induced electromotive force upon interruption of the electric power supply to the primary coil;

a center core arranged inside the primary coil;

an outer core that is quadrangular ring-shaped to have four parts thereof located respectively on opposite sides of the secondary coil in an axial direction and opposite sides of the secondary coil in a width direction perpendicular to the axial direction, the outer core and the center core together forming a closed magnetic circuit in the ignition coil;

an igniter including a switching element configured to selectively permit and interrupt the electric power supply to the primary coil, the igniter being arranged, on a low-voltage side of the outer core in the axial direction, adjacent to the outer core;

a coil case having an opening on one side in a mounting direction and a bottom part on the other side in the mounting direction, the mounting direction being perpendicular to both the axial direction and the width direction, the coil case having all of the primary coil, the secondary coil, the center core, the outer core and the igniter received therein; and an electrically-insulative fixation resin filled in spaces in the coil case to fix the primary coil, the secondary coil, the center core, the outer core and the igniter in the coil case while electrically insulating them from each other, wherein on an interior surface of the coil case on the bottom part side in the mounting direction, there is formed a case-side rib to protrude from the interior surface of the coil case to a high-voltage side in the axial direction, the high-voltage side being opposite to the low-voltage side in the axial direction, the case-side rib has a taper shape such that the protruding amount of the case-side rib to the high-voltage side in the axial direction increases in the mounting direction toward the bottom part side, and the case-side rib is arranged to abut a corner portion of the igniter on the bottom part side in the mounting direction and on the low-voltage side in the axial direction and thereby press the igniter against the outer core.

2. The ignition coil as set forth in claim 1, wherein the case-side rib has an oblique side portion that extends obliquely to both the axial direction and the mounting direction, the case-side rib is tapered to have its width in the width direction decreasing from the interior surface of the coil case to the oblique side portion, and the case-side rib is formed at such a position as to have part of the oblique side portion crushed by the corner portion of the igniter during insertion of the igniter into the coil case from the opening.

3. The ignition coil as set forth in claim 1, further comprising a primary bobbin on which the primary coil is wound, wherein the primary bobbin has an abutting part that abuts an end of the igniter on the opening side in the mounting direction, and on an interior surface of the bottom part of the coil case, there is formed an abutting part, either continuously with or separately from the case-side rib, to abut an end of the igniter on the bottom part side in the mounting direction.

4. The ignition coil as set forth in claim 1, further comprising a connector mounted to the coil case so as to protrude outside the coil case, the connector having a connector wall portion that constitutes part of the coil case on the low-voltage side in the axial direction, wherein on an interior surface of the connector wall portion, there is formed a connector-side rib to protrude from the interior surface of the connector wall portion to the high-voltage side in the axial direction, the connector-side rib has a taper part tapered such that the protruding amount of the taper part from the interior surface of the connector wall portion to the high-voltage side in the axial direction increases in the mounting direction toward the opening side, and the connector-side rib is arranged to press the igniter against the outer core.

5. The ignition coil as set forth in claim 4, wherein on the interior surface of the connector wall portion, there is also formed an abutting part that abuts an end of the igniter on the opening side in the mounting direction.

6. The ignition coil as set forth in claim 4, wherein the igniter includes an electrical conductor that protrudes, from an end of the igniter on the opening side in the mounting direction, to the opening side, the connector includes an electrical conductor that is arranged to face the electrical conductor of the igniter in the axial direction and joined to the electrical conductor of the igniter, and at least one of the electrical conductors of the igniter and the connector has an elastically-deformable portion formed therein.

7. An ignition coil for an internal combustion engine, the ignition coil comprising:

a primary coil configured to be supplied with electric power;

a secondary coil arranged outside and coaxially with the primary coil, the secondary coil being configured to generate an induced electromotive force upon interruption of the electric power supply to the primary coil;

a center core arranged inside the primary coil;

an outer core that is quadrangular ring-shaped to have four parts thereof located respectively on opposite sides of the secondary coil in an axial direction and opposite sides of the secondary coil in a width direction perpendicular to the axial direction, the outer core and the center core together forming a closed magnetic circuit in the ignition coil;

an igniter including a switching element configured to selectively permit and interrupt the electric power supply to the primary coil, the igniter being arranged, on a low-voltage side of the outer core in the axial direction, adjacent to the outer core;

a coil case having an opening on one side in a mounting direction and a bottom part on the other side in the mounting direction, the mounting direction being perpendicular to both the axial direction and the width direction, the coil case having all of the primary coil, the secondary coil, the center core, the outer core and the igniter received therein;

a connector mounted to the coil case so as to protrude outside the coil case, the connector having a connector wall portion that constitutes part of the coil case on the low-voltage side in the axial direction; and an electrically-insulative fixation resin filled in spaces in the coil case to fix the primary coil, the secondary coil, the center core, the outer core and the igniter in the coil case while electrically insulating them from each other, wherein on an interior surface of the connector wall portion, there is formed a connector-side rib to protrude from the interior surface of the connector wall portion to a high-voltage side in the axial direction, the high-voltage side being opposite to the low-voltage side in the axial direction, the connector-side rib has a taper part tapered such that the protruding amount of the taper part from the interior surface of the connector wall portion to the high-voltage side in the axial direction increases in the mounting direction toward the opening side, and the connector-side rib is arranged to press the igniter against the outer core.

8. The ignition coil as set forth in claim 7, wherein on the interior surface of the connector wall portion, there is also formed an abutting part that abuts an end of the igniter on the opening side in the mounting direction.

9. The ignition coil as set forth in claim 7, further comprising a primary bobbin on which the primary coil is wound, wherein the connector is formed integrally with the primary bobbin into one piece, and the primary bobbin has an abutting part that abuts an end of the igniter on the opening side in the mounting direction.

10. The ignition coil as set forth in claim 7, wherein the igniter includes an electrical conductor that protrudes, from an end of the igniter on the opening side in the mounting direction, to the opening side, the connector includes an electrical conductor that is arranged to face the electrical conductor of the igniter in the axial direction and joined to the electrical conductor of the igniter, and at least one of the electrical conductors of the igniter and the connector has an elastically-deformable portion formed therein.

* * * * *